US006859627B2

(12) United States Patent
Karakama et al.

(10) Patent No.: US 6,859,627 B2
(45) **Date of Patent: *Feb. 22, 2005**

(54) IMAGE DEVELOPING APPARATUS, PROCESS CARTRIDGE, ELECTROPHOTOGRAPHIC IMAGE FORMING APPARATUS, AND DEVELOPING UNIT FRAME

(75) Inventors: Toshiyuki Karakama, Shizuoka-ken (JP); Kazushige Sakurai, Gotenba (JP); Toru Oguma, Mishima (JP); Hideki Matsumoto, Mishima (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 49 days.

(21) Appl. No.: 09/469,517

(22) Filed: Dec. 22, 1999

(65) Prior Publication Data

US 2002/0012542 A1 Jan. 31, 2002

(30) Foreign Application Priority Data

Dec. 28, 1998 (JP) ..... 10-373834

(51) Int. Cl.[7] ..... G03G 15/08
(52) U.S. Cl. ..... 399/27; 399/61
(58) Field of Search ..... 399/27, 30, 53, 399/58, 61, 62, 73

(56) References Cited

U.S. PATENT DOCUMENTS

| | | | | |
|---|---|---|---|---|
| 4,133,453 A | * | 1/1979 | Ohbora | 399/61 X |
| 5,003,917 A | | 4/1991 | Toyoshi et al. | 118/653 |

(List continued on next page.)

FOREIGN PATENT DOCUMENTS

| | | | |
|---|---|---|---|
| CA | 2128676 | | 12/1997 |
| EP | 0 586 042 A2 | | 3/1994 |
| EP | 0 770 932 A1 | | 5/1997 |
| EP | 0 840 182 A2 | | 5/1998 |
| JP | 57-154268 | * | 9/1982 |
| JP | 02-197880 | * | 8/1990 |
| JP | 04-355477 | * | 12/1992 |
| JP | 5-100571 | | 4/1993 |
| JP | 9-190067 | | 7/1997 |
| JP | 9-211960 | | 8/1997 |

OTHER PUBLICATIONS

Patent Abstracts of Japan, vol. 1997, No. 12, Dec. 25, 1997 (JP 09–211960).

(List continued on next page.)

*Primary Examiner*—Sandra L. Brase
(74) *Attorney, Agent, or Firm*—Fitzpatrick, Cella, Harper & Scinto

(57) ABSTRACT

A developing device for developing an electrostatic latent image formed on an electrophotographic photosensitive member, said developing device being mountable to a main assembly of an electrophotographic image forming apparatus, said developing device includes a developer carrying member for feeding a developer to said electrophotographic photosensitive member to develop the electrostatic latent image formed on the electrophotographic photosensitive member; a first electroconductive portion; a second electroconductive portion for cooperating with said first electroconductive portion to provide an electrostatic capacity; a first electrical contact for receiving a voltage to be applied to said first electroconductive portion from the main assembly of the electrophotographic image forming apparatus; a second electrical contact for transmitting, to the main assembly of the electrophotographic image forming apparatus, an electric signal corresponding to an electrostatic capacity between said first electroconductive portion and said second electroconductive portion when a voltage is applied to said first electroconductive portion to detect a remaining amount of the developer by the main assembly of the electrophotographic image forming apparatus.

39 Claims, 27 Drawing Sheets

U.S. PATENT DOCUMENTS 5,198,860 A * 3/1993 Yamanaka et al. ..... 399/27
5,229,821 A 7/1993 Fujii
5,294,960 A 3/1994 Nomura et al.
5,455,665 A 10/1995 Baba et al.
5,475,471 A 12/1995 Kisu et al.
5,500,714 A 3/1996 Yashiro et al.
5,534,344 A 7/1996 Kisu et al. ..... 428/323
5,541,711 A 7/1996 Kisu et al.
5,543,898 A 8/1996 Shishido et al.
5,585,895 A 12/1996 Yashiro et al.
5,617,579 A 4/1997 Yashiro et al. ..... 399/114
5,623,328 A 4/1997 Tsuda et al. ..... 399/111
5,689,774 A 11/1997 Shishido et al. ..... 399/111
5,749,027 A 5/1998 Ikemoto et al. ..... 399/113
5,765,077 A 6/1998 Sakurai et al. ..... 399/176
5,768,658 A 6/1998 Watanabe et al. ..... 399/111
5,768,660 A 6/1998 Kurihara et al. ..... 399/111
5,774,766 A 6/1998 Karakama et al. ..... 399/111
5,790,923 A 8/1998 Oguma et al. ..... 399/106
5,794,101 A 8/1998 Watanabe et al. ..... 399/103
5,802,419 A * 9/1998 Sakurai et al. ..... 399/27 X
5,812,909 A 9/1998 Oguma et al. ..... 399/103
5,828,928 A 10/1998 Sasago et al. ..... 399/111
5,878,310 A 3/1999 Noda et al. ..... 399/117
5,884,124 A 3/1999 Karakama et al. ..... 399/123
5,890,036 A 3/1999 Karakama et al. ..... 399/119
5,899,602 A 5/1999 Noda et al. ..... 399/111
5,920,752 A 7/1999 Karakama et al. ..... 399/111
5,943,528 A 8/1999 Akutsu et al. ..... 399/110
5,946,522 A 8/1999 Inami ..... 399/27
5,966,566 A 10/1999 Odagawa et al. ..... 399/109
5,987,269 A * 11/1999 Allen et al. ..... 399/27

OTHER PUBLICATIONS

Patent Abstracts of Japan, vol. 018, No. 484 (p–1798) Sep. 8, 1994 (JP 06–161242).

Patent Abstracts of Japan, vol. 007, No. 238 (P–231) Oct. 22, 1983 (JP 58–126556).

Patent Abstracts of Japan, vol. 013, No. 462 (M–881) Oct. 19, 1989 (JP 01–180379).

* cited by examiner

IMAGE DEVELOPING APPARATUS, PROCESS CARTRIDGE, ELECTROPHOTOGRAPHIC IMAGE FORMING APPARATUS, AND DEVELOPING UNIT FRAME

FIELD OF THE INVENTION AND RELATED ART

The present invention relates to an image developing apparatus, a process cartridge, an electrophotographic image forming apparatus, and a development unit frame.

An electrophotographic image forming apparatus includes an electrophotographic copying machine, an electrophotographic printer (for example, LED printer, laser beam printer, and the like), an electrophotographic facsimile apparatus, an electrophotographic word processor, and the like.

A process cartridge is a cartridge which integrally comprises a charging means, a developing meaning or a cleaning means, and an electrophotographic photosensitive member, and is removably installable in the main assembly of an electrophotographic image forming apparatus; a cartridge which integrally comprises at least a developing means, and an electrophotographic photosensitive member, and is removable installable in the main assembly of an image forming apparatus.

In the past, an image forming apparatus which employed an electrophotographic image formation process employed a process cartridge system, according to which an electrophotographic photosensitive member, and one or a plurality of processing means which works on the electrophotographic photosensitive member, are integrally assembled in the form of a cartridge removably installable in the main assembly of an image forming apparatus. Also according to this process cartridge system, the maintenance for an image forming apparatus can be performed by a user him/her self; the user does not need to rely on a service person for the maintenance. Therefore, the employment of a process cartridge system drastically improved the operational efficiency of an image forming apparatus. As a result, a process cartridge system has been widely used in the field of the image forming apparatus.

In the case of an image forming apparatus such as the above described electrophotographic image forming apparatus which employs a process cartridge system, a user him/herself must exchange a cartridge. Therefore, the image forming apparatus is provided with a means for informing the user of developer depletion, for example, an developer amount detecting apparatus.

In the past, in order to detect the amount of developer remainder, a pair of electrodes in the form of a rod are placed in the developer container of a developing means, and the amount of the developer in the developer container was determined by detecting the changes which occurred to the eletrostatic capacity between the two electrodes.

Japanese Laid-Open Patent Application No. 100571/1993 discloses a developer amount detecting apparatus, which employs a developer amount detecting member comprising two electrodes placed in the same plane in parallel to each other, one being in the shape of a "U", and the other being in the shape of a "I" so that they can be coupled on the same plane. This developer amount detecting member is located at the bottom portion of the developer container. This development amount detecting apparatus detects the amount of remaining developer by detecting the fluctuation in the electrostatic capacity between the parallel electrodes placed in the same plane.

However, the above described developer amount detecting apparatus is of a type which detects the presence (absence) of the developer within the developer container. More specifically, it is of a type that detects the developer shortage only immediately before the depletion of the developer within the developer container. In other words, it is not enabled to continuously detect how much developer remained in the developer container.

Thus, if it is possible to continuously detect the amount of the developer remaining in the developer container, a user can know the state of developer usage in the developer container, which makes it possible for the user to prepare a new process cartridge for exchange. This is very convenience for the user.

SUMMARY OF THE INVENTION

The primary object of the present invention is to provide an image developing apparatus, a process cartridge, and an electrophotographic image forming apparatus, which are capable of continuously detecting the amount of the developer remainder, and a developing apparatus usable for a process cartridge and an electrophotographic image forming apparatus.

Another object of the present invention is to provide an electrophotographic image forming apparatus, which comprises a developer amount detecting means capable of continuously detecting the amount of the developer remainder in accordance with the consumption of the developer within the developer container, to offer more convenience to a user in terms of usage, as well as a process cartridge, a developing apparatus, and a development unit frame, which are compatible with the above electrophotographic image forming apparatus.

Another object of the present invention is to provide a development unit frame better designed for improving the aforementioned process cartridge and developing apparatus in terms of quality and assembly efficiency, and also, installing the developer amount detecting means, or the like, capable of continuously detecting the amount of the developer in the development chamber in accordance with the developer consumption, into the aforementioned process cartridge or developing apparatus.

According to an aspect of the present invention, a developing apparatus, a process cartridge, or an electrophotographic image forming apparatus which employs a developing apparatus and a process cartridge, comprises: a first electrically conductive portion; a second electrically conductive portion opposing the first electrically conductive portion to provide electrostatic capacity between the first and second electrically conductive portions; a first electrical contact for receiving the voltage to be applied to the first electrically conductive portion, from the electrophotographic image forming apparatus main assembly; and a second electrical contact for transmitting to the electrophotographic image forming apparatus main assembly, electrical signals generated in accordance with the electrostatic capacity provided between the first and second electrically conductive portions, as voltage is applied to the first electrically conductive portion, in order to enable the electrophotographic image forming apparatus main assembly to detect the amount of the remaining developer.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinafter, an image developing apparatus, a process cartridge, an electrophotographic image forming apparatus, and a development unit frame, which are in accordance with the present invention will be described in more detail with reference to the appended drawings.

Embodiment 1

Figure 1:
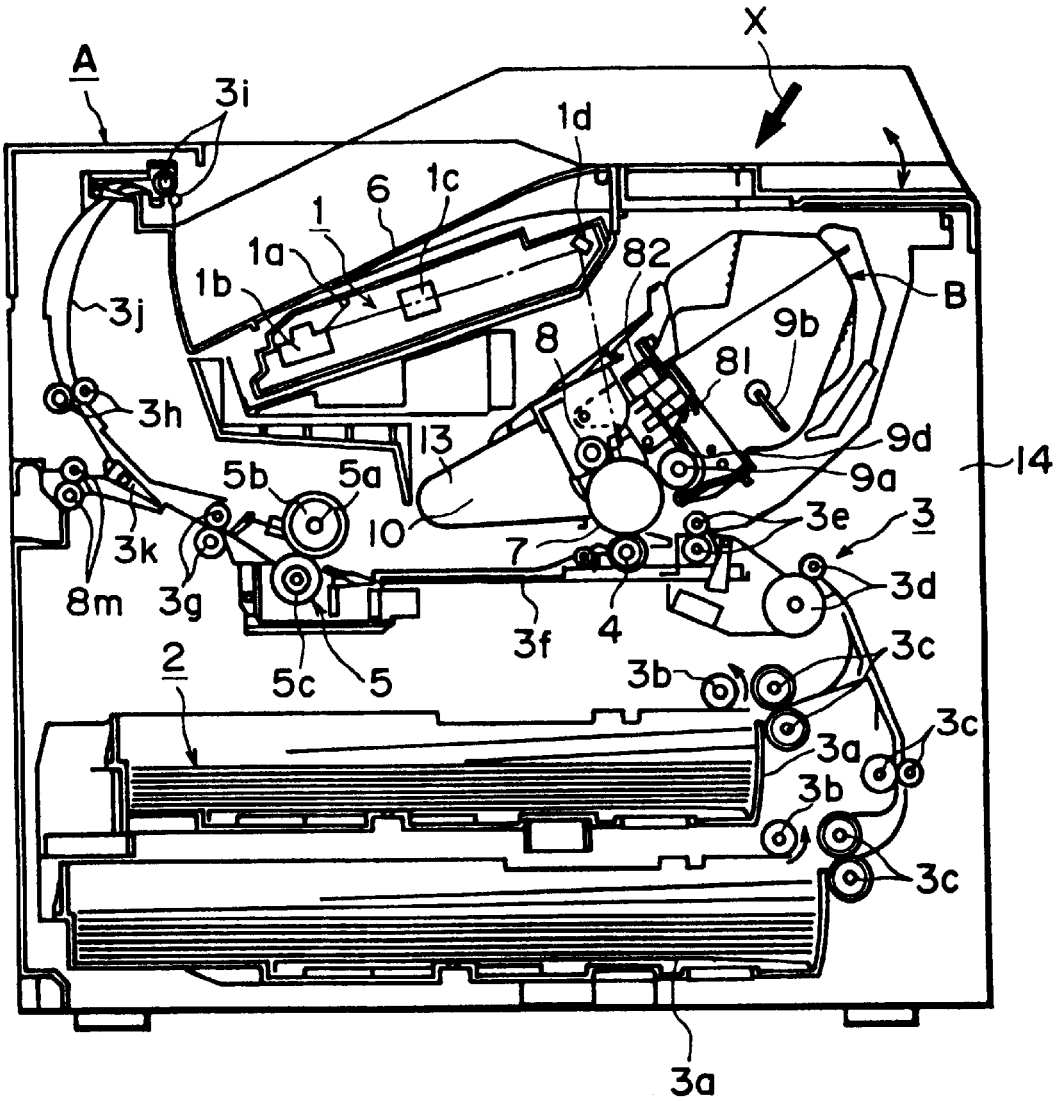
FIG. 1 is a schematic vertical sectional view of an example of an electrophotographic image forming apparatus in accordance with the present invention, and depicts the general structure thereof.
Figure 2:
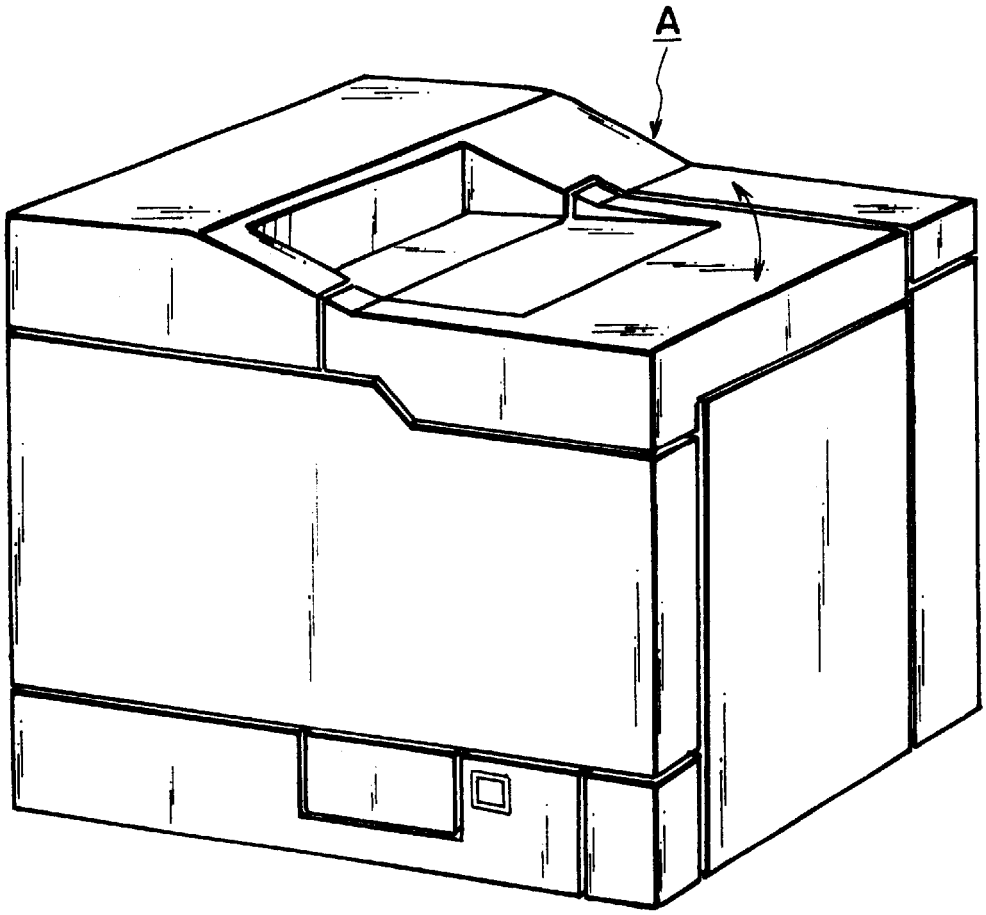
FIG. 2 is an external perspective view of the electrophotographic image forming apparatus in accordance with the present invention.

First, referring to FIG. 1, an example of an electrophotographic image forming apparatus in which a process cartridge configured in accordance with the present invention is installable will be described. The electrophotographic image forming apparatus in this embodiment is an electrophotographic laser beam printer, which forms images on various recording media, for example, recording paper, OHP sheet, fabric, and the like, with the use of an electrophotographic image formation process.

A laser beam printer A is provided with an electrophotographic photosensitive member in the form of a drum, that is, a photosensitive drum 7. The photosensitive drum 7 is charged by a charge roller 8, i.e., a charging means. Then, a laser beam modulated with image data is projected onto the photosensitive drum 7, from an optical means 1 comprising a laser diode 1*a*, a polygon mirror 1*b*, a lens 1*c*, and a deflection mirror 1*d*. As a result, a latent image is formed on the photosensitive drum 7 in correspondence to the image data. This latent image is developed into a toner image, i.e., a visible image, by a developing means 9.

Figure 3:
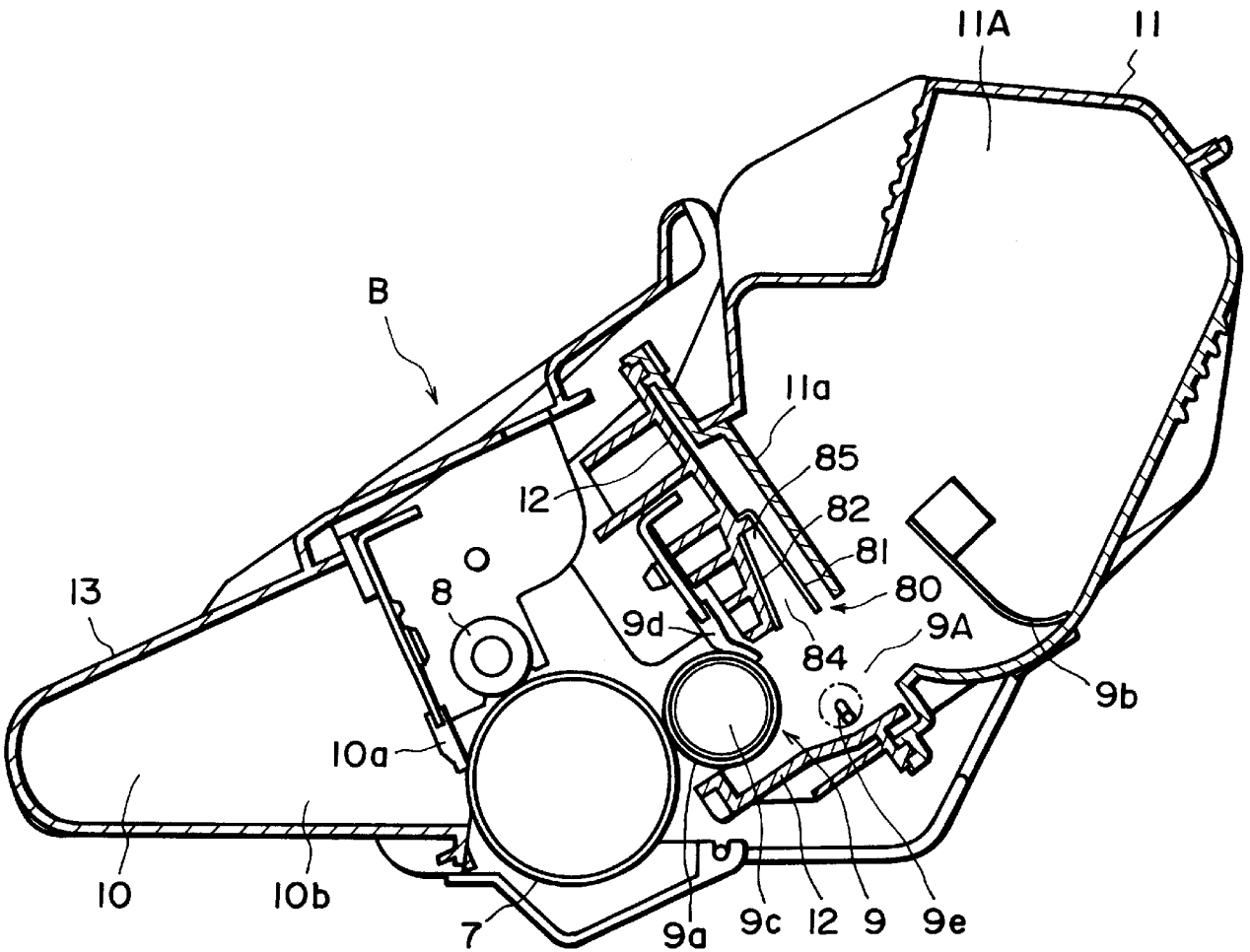
FIG. 3 is a vertical cross sectional view of a process cartridge in accordance with the present invention.

Referring to FIG. 3, which makes it easier to understand the following description, the developing means 9 is provided with a development chamber 9A in which a development roller 9*a* as a developer bearing member is disposed. The developer in a developer container 11A, as a developer storage portion, located next to the development chamber 9A is sent to the development roller 9*a* by the rotation of a developer sending member 9*b*. In the development chamber 9A, a developer stirring member 9*e* is disposed adjacent to the development roller 9*a*, to circulate the developer in the development chamber 9A. The development roller 9*a* contains a stationary magnet 9*c*. As the development roller 9*a* is rotated, the developer is borne and carried by the peripheral surface of the development roller 9*a*. Then, as the development roller 9*a* is rotated further, the developer on the development roller 9*a* is regulated by a development blade 9*d* into a developer layer with a predetermined thickness, while being triboelectrically charged, and is delivered to the image developing area. In this image developing area, the developer is transferred from the development roller 9*a* onto the latent image on the photosensitive drum 7. As a result, a toner image is formed an the photosensitive drum 7. The development roller 9*a* is connected to a development bias circuit so that development bias is applied to the development roller 9*a*. Normally, the development bias is compound bias comprising AC voltage and DC voltage.

Meanwhile, a piece of recording medium 2 is conveyed from a sheet feeder cassette 3*a*, which stores plural sheets of recording medium 2, to an image transfer area by a combination of a pickup roller 3*b*, conveyer roller pairs 3*c* and 3*d*, and a registration roller pair 3*e*, in synchronism with the progress of the toner image formation. In the transfer area, a transfer roller 4 as an image transferring means is disposed, and as voltage is applied to the transfer roller 4, the toner image on the photosensitive drum 7 is transferred onto the recording medium 2.

After the transfer, the recording medium 2 is conveyed to a fixing means 5 along a conveyer guide 3*f*, and passed through the fixing means 5, which comprises a driving roller 5*c*, and a fixing roller 5*b* containing a heater 5*a*. As the recording medium 2 is passed through the fixing means 5, the toner image having been transferred onto the recording medium 2 is fixed to the recording medium 2 with the application of heat and pressure from the fixing means 5.

Thereafter, the recording medium 2 is advanced further, is passed through a reversal path 3*j*, and then, is discharged into a delivery tray 6, by discharge roller pairs 3*g*, 3*h* and 3*i*. The delivery tray 6 is located at the top of the main assembly 14 of the laser beam printer A, i.e., an electrophotographic image forming apparatus. It should be noted here that the recording medium 2 can be discharged from the apparatus main assembly 14, without going through the reversing path 3*j*, by activating a flapper 3*k*. In such a case, the recording medium 2 is discharged by a discharge roller pair 3*m*. In this embodiment, the aforementioned pickup roller 3*b*, conveyer roller pairs 3*b*, 3*c* and 3*d*, and registration roller pair 3*e*, conveyance guide 3*f*, discharge roller pairs 3*g*, 3*h* and 3*i*, and discharger roller pair 3*m*, make up the conveying means.

After the toner image transfer onto the recording medium 2 by the transfer roller 4, the photosensitive drum 7 is cleaned by a cleaning means 10; the developer remaining on the photosensitive drum 7 is removed by the cleaning means 10. Then, the photosensitive drum 7 is reused for the following cycle of image formation process. The cleaning means 10 comprises an elastic cleaning blade 10*a* placed in contact with the photosensitive drum 7. It scrapes away the toner remaining on the photosensitive drum 7 from the photosensitive drum 7, and collects it into a waste toner bin 10*b*.

Referring to FIG. 3, the process cartridge B in this embodiment is an integral assembly of various frames and components therein. In production, a development unit (which makes up the developing apparatus portion) is formed by a welding a developer storage frame 11 comprising a developer container (developer storage portion) for storing the developer, and a developer conveying member 9*b*, to a development unit frame 12 which holds the developing means 9 made up of the development roller 9*a*, development blade 9*d*, and the like. Then, the process cartridge B is completed by integrally uniting this development unit with a cleaning unit frame 13 in which the photosensitive drum 7, the cleaning means 10 made up of the cleaning blade 10*a* and the like, and the charger roller 8, are disposed.

The process cartridge B is rendered removably installable in the cartridge installing means with which the main assembly 14 of an electrophotographic image forming apparatus is provided. The cartridge installing means in this embodiment is made up of a guiding means 13R (13L) formed as a part of the external right (left) wall of the process cartridge B (FIG. 4), and guide portions 16R (16L) (FIG. 5) formed as a part of the apparatus main assembly 14, in which the guiding means 13R (13L) is insertable.

Further, the process cartridge B in this embodiment is provided with a developer amount detecting apparatus as a means capable of continuously detecting the amount of the developer remainder in the development chamber 9A as the developer in the development chamber 9A is consumed.

Referring to FIG. 3, the developer amount detecting apparatus in this embodiment comprises first and second electrically conductive portions (electrodes) 81 and 82, which are measurement electrodes, and are parts of developer detecting portion 80. The electrodes 81 and 82 are disposed along the development roller 9*a*. In order to detect the amount of the developer, voltage is applied to the first electrode 81 or the second electrode 82 to induce static electricity between the electrodes 81 and 82, so that the amount of the developer is calculated from the measurement of the amount of the electrostatic capacity between the two electrodes 81 and 82. In this embodiment, voltage is applied to the first electrode 81. This process will be described later in detail.

The magnetic developer is attracted to the peripheral surface of the development roller 9*a* by the magnetic roller 9*c* contained in the developer roller 9*a*, and is borne on the peripheral surface of the development roller 9*a* as the developer 9*a* is rotated. Then, as the development roller 9*a* is rotated further, the magnetic developer on the development roller 9*a* is scraped by the development blade 9*d*. As a result, an even layer of the magnetic developer is formed on the peripheral surface of the development roller 9*a*.

The first and second electrodes 81 and 82 are positioned so that the excessive developer scraped away from the development roller 9*a* enters between them.

Figure 7:
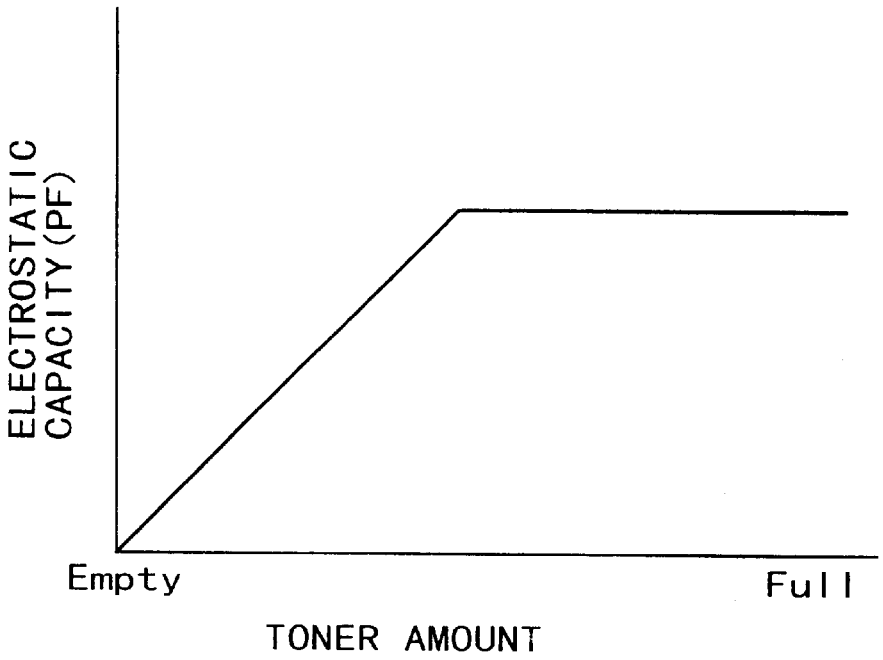
FIG. 7 is a graph which shows the relationship between the toner amount and electrostatic capacity in the developer amount detecting apparatus in accordance with the present invention.

The dielectric constant of developer is greater than that of air. Therefore, when there is developer between the first and second electrodes 81 and 82, the electrostatic capacity between the two electrodes is greater than when not. In other words, when a sufficient amount of developer is in the development chamber 9A, a larger electrostatic capacity is provided between them than when not, because, when a sufficient amount of developer is in the development chamber 9A, the aforementioned developer scraped away from the development roller 9*a* continuously enters between the first and second electrodes 81 and 81. Then, as the developer in the development chamber 9A is consumed, the amount of the developer which enters between the electrodes 81 and 82 gradually decreases, which in turns reduces the electrostatic capacity between them. Thus, the developer amount detecting apparatus continuously detects the developer amount by detecting the change in the electrostatic capacity between the two electrodes. FIG. 7 schematically shows this concept, which will be described later in detail.

In order to improve the accuracy with which the developer amount is continuously detected, all that is necessary is to increase the amount of change in the aforementioned electrostatic capacity, by increasing the sizes of the first and second electrodes 81 and 82. In particularly, it is desired that the widths of the opposing surfaces of the first and second electrodes 81 and 83 are rendered greater than the distance between the two electrodes.

Referring to FIGS. 11–18, which will be helpful to better understand this embodiment, the first and second electrodes 81 and 82 in this embodiment are long and narrow members which extend in the longitudinal direction of the development roller 9*a*. They are formed of electrically conductive material such as stainless steel (SUS), iron, phosphor bronze, aluminum, electrically conductive resin, and the like, which are identical in terms of electrode function. However, in this embodiment, nonmagnetic metallic material such as nonmagnetic SUS was employed to prevent the electrode material from affecting developer circulation.

More specifically, in this embodiment, the first electrode 81 was formed of nonmagnetic SUS, and was 14 mm in width (W1), and 0.3 mm in thickness (t1). The second electrode 82 was formed of nonmagnetic SUS, and was 17 mm in width (W2), and 0.5 mm in thickness (t2). Arranging these electrodes along and in parallel to the development roller 9*a* in the longitudinal direction produced good results. The configurations of the electrodes 81 and 82 need not be limited to particular one. However, arranging the electrodes 81 and 82 non-parallel so that the gap between the two electrodes becomes wider on the side from which the developer enters than on the inward side 85, as shown in FIG. 3, provides good results.

Figure 8:
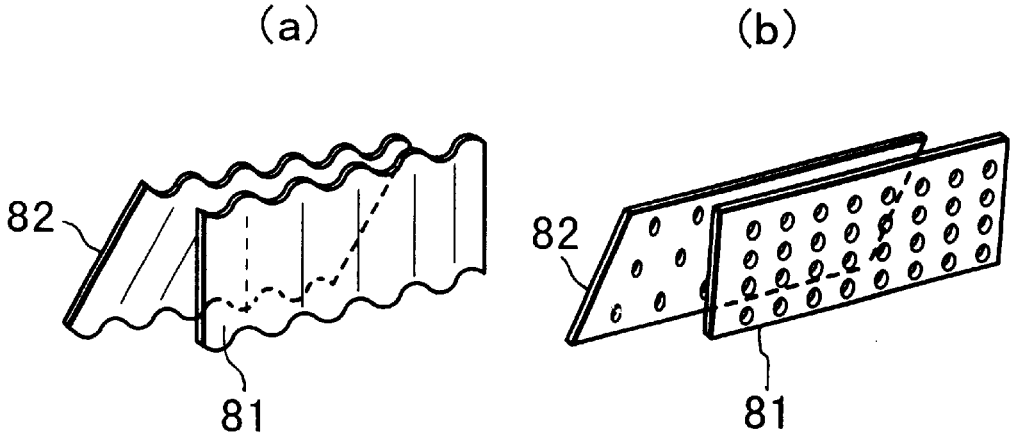
FIG. 8 is a perspective view of the first and second electrodes in the developer amount detecting apparatus in accordance with the present invention.
Figure 9:
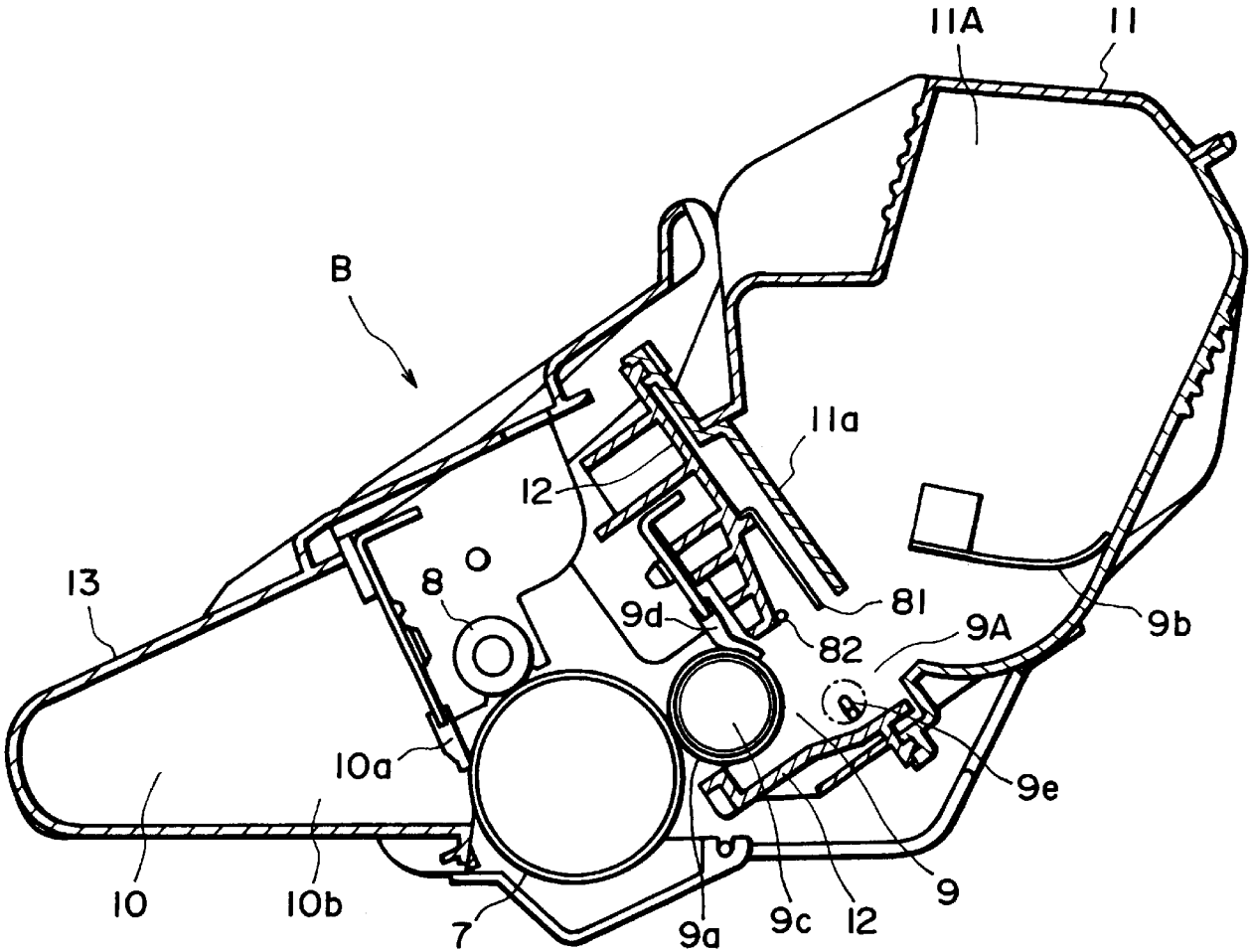
FIG. 9 is a vertical cross-sectional view of another example of the process cartridge in accordance with the present invention.
Figure 10:
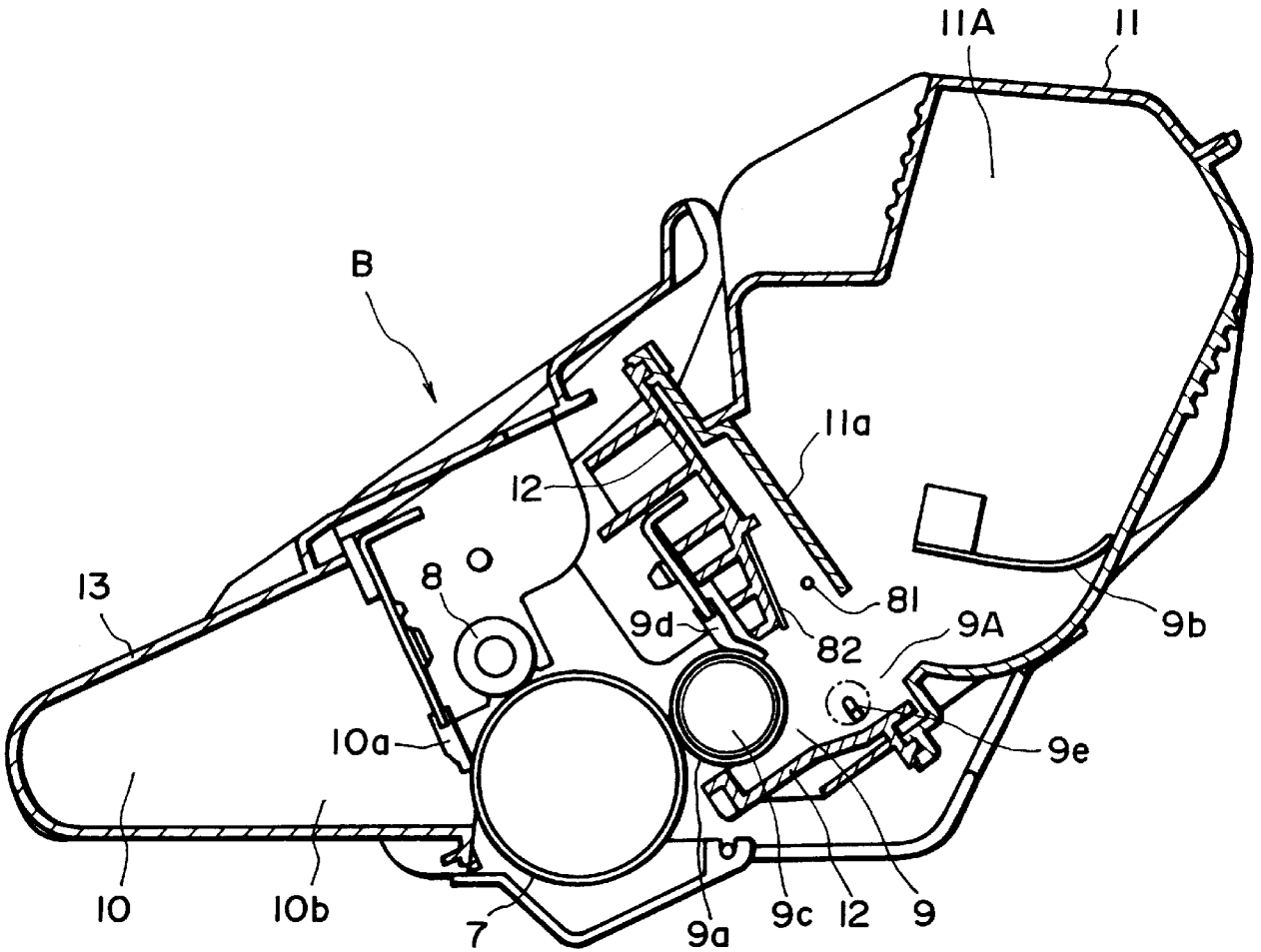
FIG. 10 is a vertical cross-sectional view of another example of the process cartridge in accordance with the present invention.
Figure 11:
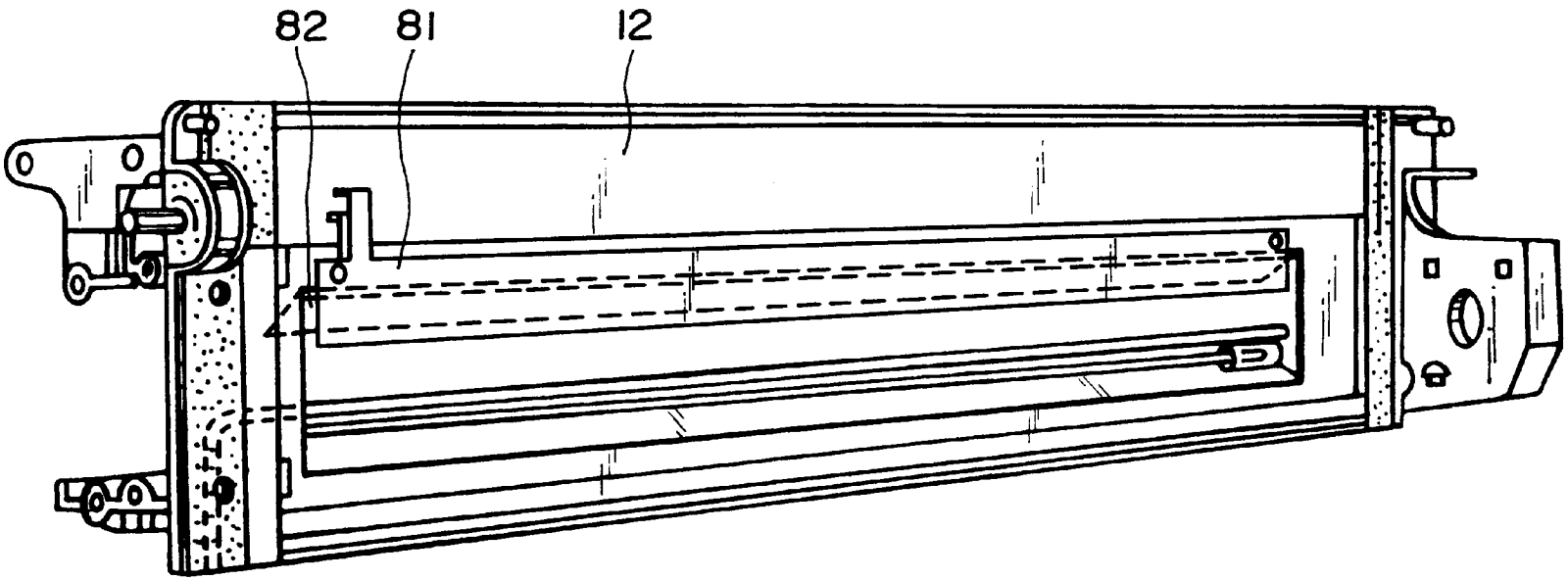
FIG. 11 is a perspective view of the development unit frame, and depicts how the first and second electrodes are attached to the development unit frame.

Further, in order to increase the surface areas of the electrodes 81 and 82, the electrodes 81 and 82 may be formed on a corrugated, or embossed sheet of material, as shown in FIG. 8. If it is impossible to secure a space for larger electrodes, because of design related reasons, or if it is desired to reduce the cost, either the first electrode 81 or the second electrode 82 may be formed in the form of a round rod as illustrated in FIGS. 9 and 10, which show the examples of such arrangement, and in which the first and second electrodes, respectively, are in the form of a round rod. Although the number of the rod in the examples illustrated in FIGS. 9 and 10 is singular, it may be plural.

Figure 12:
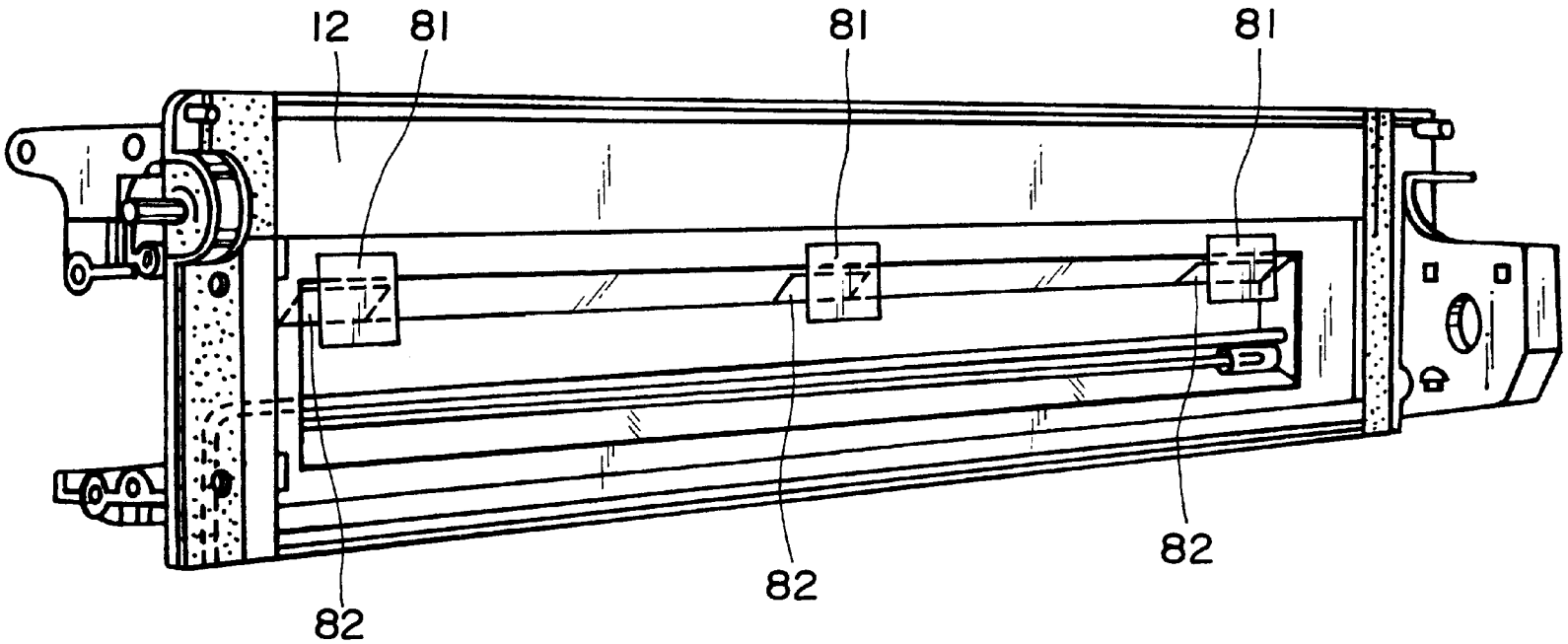
FIG. 12 is a perspective view of the development unit frame, and depicts another way the first and second electrodes are attached to the development unit frame.

Next, the positioning of the electrodes 81 and 82 in the longitudinal direction will be described. In terms of the longitudinal direction of the development roller 9*a*, the first and second electrodes 81 and 82 may be extended to a length approximately the same as the length of the image formation range, to increase the aforementioned electrostatic capacity so that the detection accuracy is improved. When the detection accuracy is of somewhat less concern, a pair of narrower electrodes, in terms of the longitudinal direction, may be disposed at either the center, or figure, portion of the image formation range to reduce the cost. In the case of such an arrangement, however, it is not possible to detect whether or not the developer is unevenly distributed in terms of the longitudinal direction. In order to solve such a problem, it is desired that a combination of narrow electrodes 81 and 82 be positioned at each of a plurality of locations; for example, the center and both fingers as shown in FIG. 12.

Next, referring to FIGS. 13–16, the developer circulation within the development chamber 9A will be described.

Figure 13:
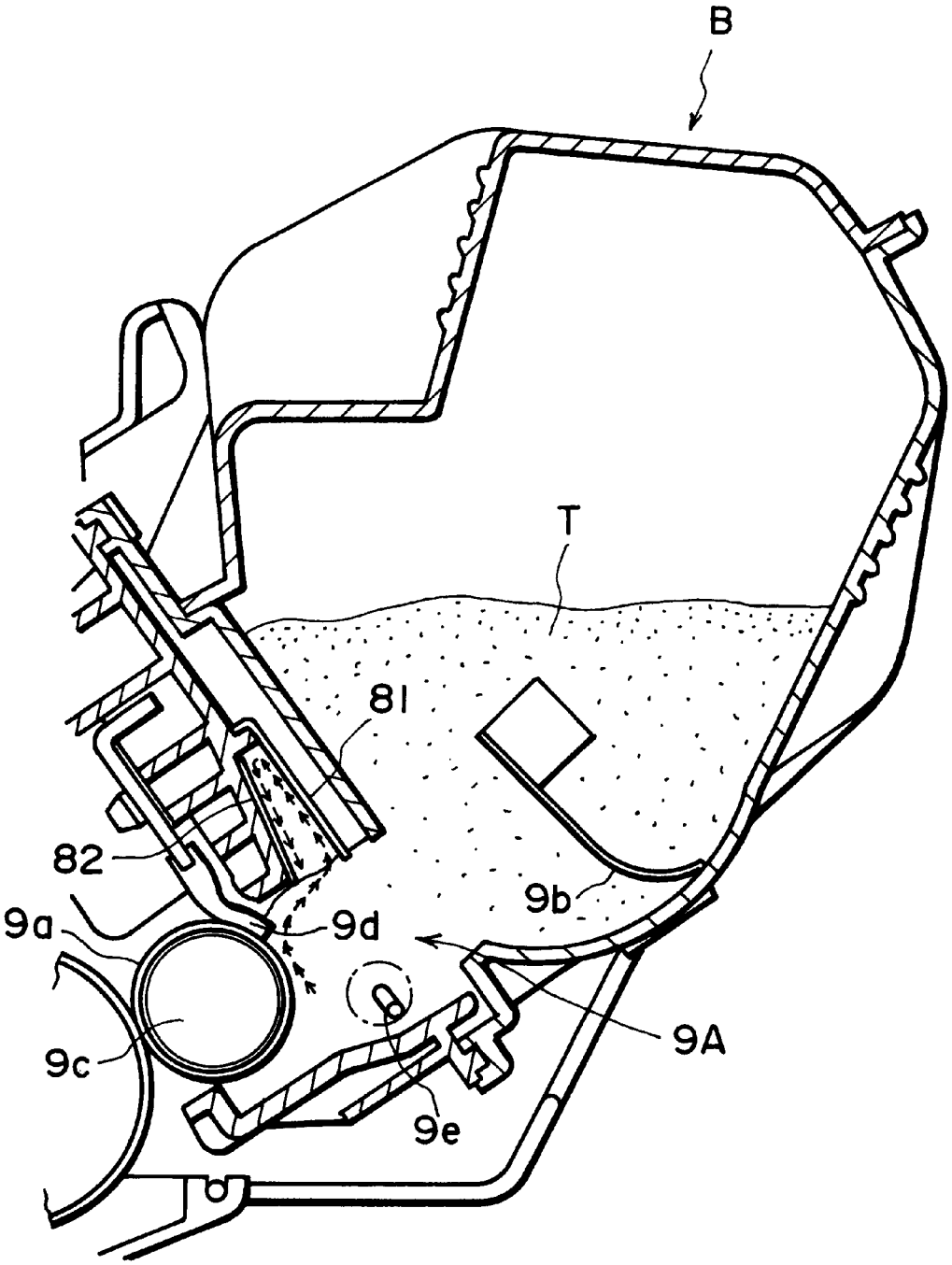
FIG. 13 is a vertical cross-sectional view of the process cartridge in accordance with the present invention, and depicts how the developer is circulated in the development chamber.

When a process cartridge, more specifically, the developing apparatus portion of the process cartridge, in accordance with the present invention, is used for the first time, no developer is present between the first and second electrodes 81 and 82, although a sufficient amount of developer T is present in the development chamber 9A. In this situation, first, the developer T in the development chamber 9A is sent toward the development roller 9*a* by the stirring member 9*e*, and then, is attracted to the peripheral surface of the development roller 9*a* Then, as the development roller 9*a* is rotated, the developer is borne on the peripheral surface of the development roller 9*a*. As the development roller 9*a* is rotated further, the developer on the peripheral surface of the development roller 9*a* is leveled, that is, the excess amount of the developer on the peripheral surface of the development roller 9*a* is scraped away, and as it is scraped away, it enters between the first and second electrodes 81 and 82, as illustrated in FIG. 13.

Figure 14:
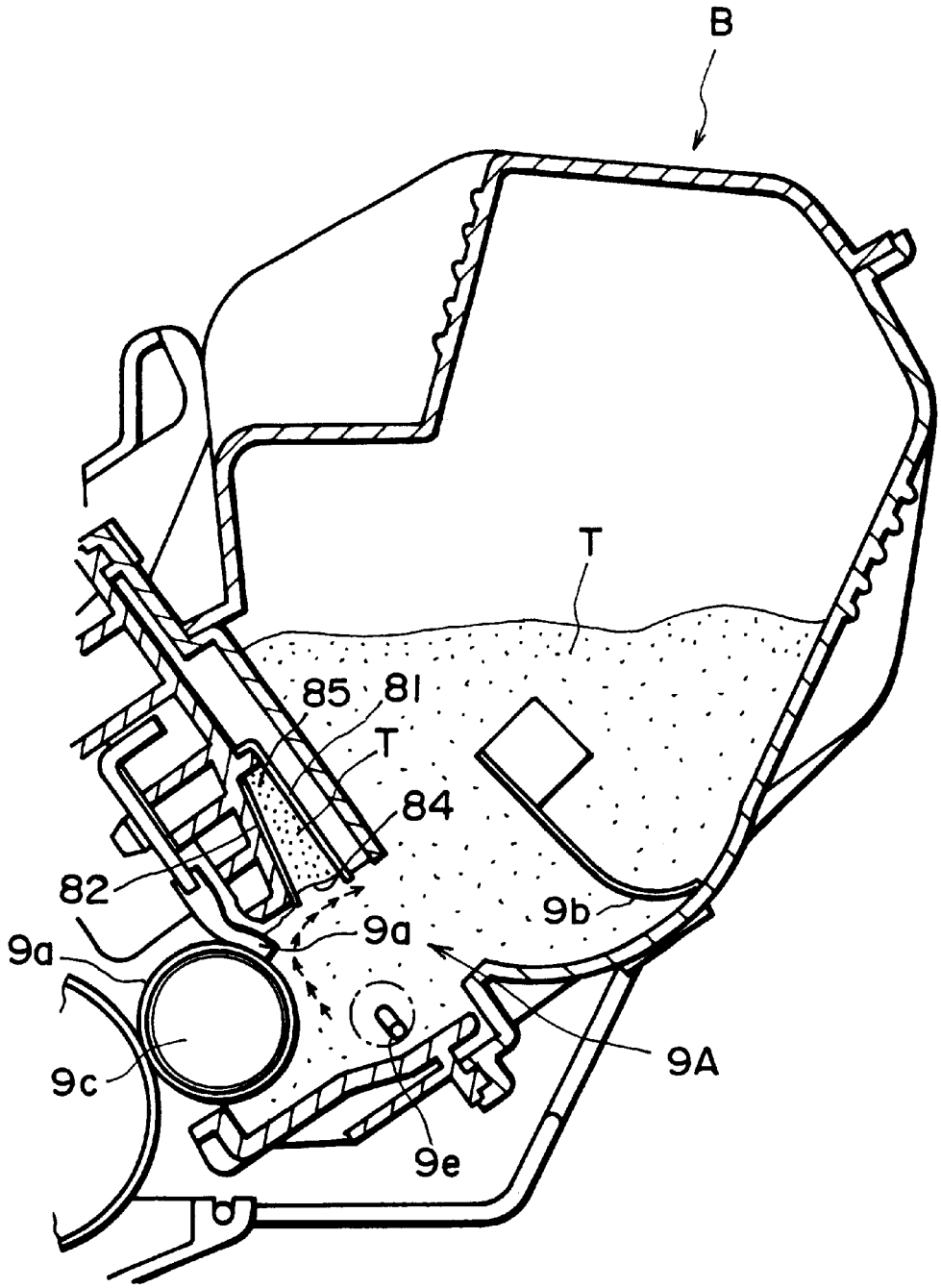
FIG. 14 is a vertical cross-sectional view of the process cartridge in accordance with the present invention, and depicts how the developer is circulated in the development chamber.

As the developer T continues to enter into the gap between the first and second electrodes 81 and 82, the gap is filled with the developer T which enters the gap, as illustrated in FIG. 14. At this point, however, the development chamber 9A is still full of the developer T. Therefore, once the developer T enters the gap through the entrance 84, that is, the bottom side of the gap between the electrodes 81 and 82, it is blocked by the developer T in the development chamber 9A. Therefore, it does not occur until the amount of the developer T in the development chamber 9A reduces by a substantial amount that the developer T between the electrodes 81 and 82 free falls out of the gap between the two electrodes due to gravity or the like. In other words, when there is a sufficient amount of the developer T in the development chamber 9A, the gap between the first and second electrodes 81 and 82 is filled when the developer T, and therefore, the electrostatic capacity between the two electrodes is high.

Figure 15:
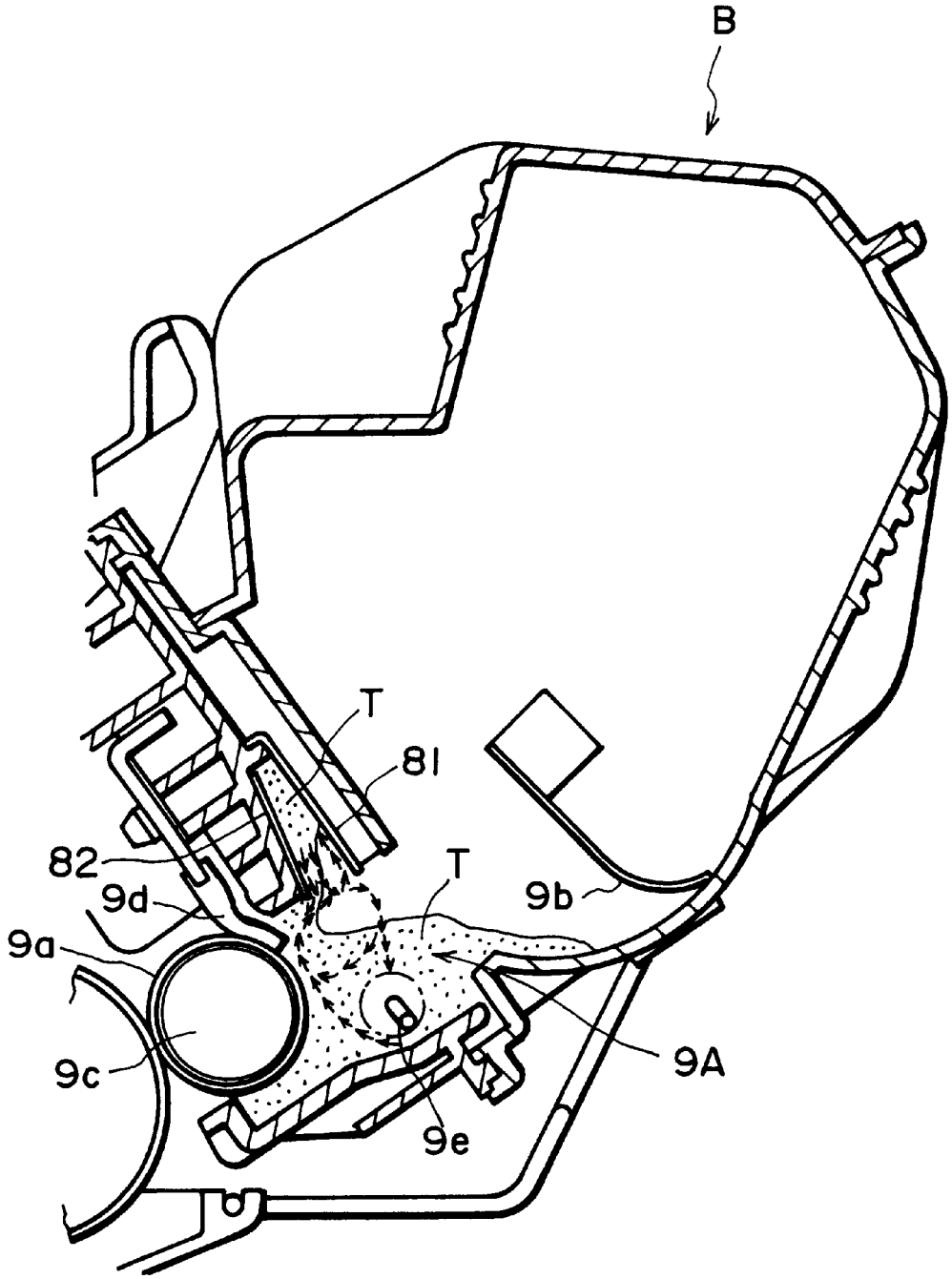
FIG. 15 is a vertical cross-sectional view of the process cartridge in accordance with the present invention, and depicts how the developer is circulated in the development chamber.
Figure 16:
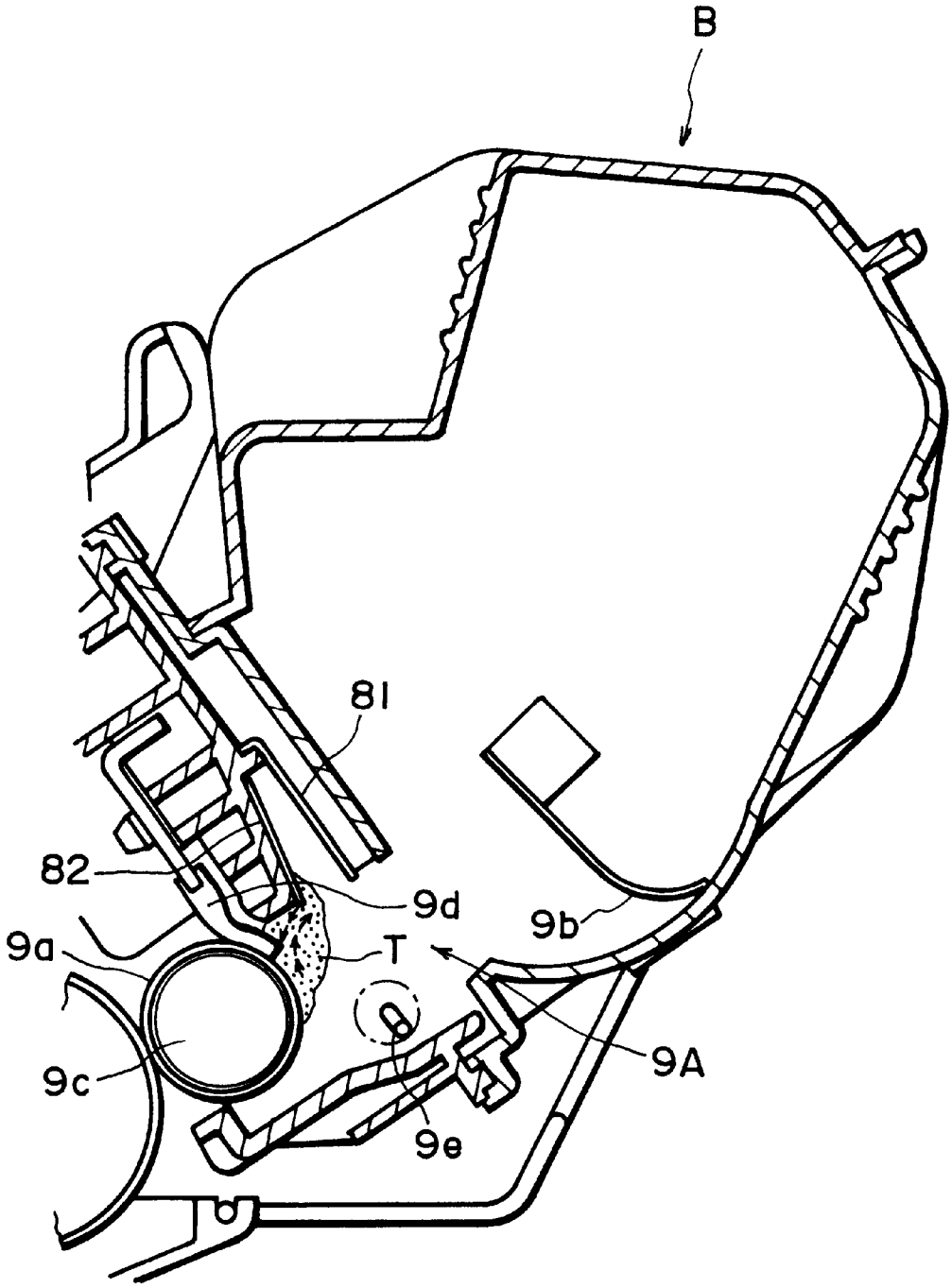
FIG. 16 is a vertical cross-sectional view of the process cartridge in accordance with the present invention, and depicts how the developer is circulated in the development chamber.

Referring to FIG. 15, as the mount of the developer T in the developer container 11A and development change 9A is reduced due to developer consumption, the portion of the developer that has been blocking the entrance (also, exit) 84 moves away from the entrance 84, allowing the developer T between the first and second electrodes 81 and 82 to free fall in the direction of gravity due to its own weight. Some portion of the developer T that free falls may be attracted to the development roller 9*a* by the magnetic force as it falls, whereas the other may simply fall all the way to join the rest of the developer T in the development chamber 9A to be supplied again to the development roller 9*a*. Also, in a certain class the developer T between the two electrodes is caused to directly return to the peripheral surface of the development roller 9*a* by the magnetic force.

In the situation illustrated in FIG. 15, the amount of the developer in the development chamber 9A has become small enough to allow the developer between the electrodes 81 and 82 to come out from between them. However, the developer still remains in the development chamber 9A by an amount sufficient to make it necessary for the developer to be scraped away from the development roller 9*a* by the development blade 9*b* to be supplied into the gap between the first and second electrodes 81 and 82, and therefore, the amount of the developer between the electrodes 81 and 82 gradually reduces in accordance with the amount of the developer remaining in the development chamber 9A.

In the last stage of toner consumption in the process cartridge B, that is, after the developer in the developer container 11A and development chamber 9A has been virtually entirely consumed, the developer which remains adjacent to the tip of the development blade 9*d* for scraping away the excess amount of the developer layer on the peripheral surface of the development roller 9*a*, that is, the developer remaining between the development roller 9*a* and first electrode 82 is consumed until the developer is completely depleted (END state). During this stage, the resultant prints tend to suffer from white spots.

As is evident from the above description, according to this embodiment, the amount of the developer in the development chamber 9A is determined by measuring the amount of the developer between the first and second electrodes 81 and 82, which can be continuously detected by measuring the eletrostatic capacity between the electrodes 81 and 82.

Also according to this embodiment, the structure configuration adjacent to the electrodes 81 and 82 is such that the gap between the first and second electrodes 81 and 82 is provided with no opening at the inward end 85; the gap is provided with only one opening 84, which serves as the entrance as well as the exit. Therefore, widening the gap between the electrodes 81 and 82, on the side of the developer entrance 84 (also, exit), as described above, is effective to allow the developer to easily enter, or come out from, between the two electrodes.

However, if the amount of the developer scraped away from the peripheral surface of the development roller 9*a* by the development blade 9*b* per unit of time increases because of the increase in the rotational speed of the development roller 9*a*, or the like, the amount of the developer entering between the first and second electrodes 81 and 82 also increases, and sometimes, the developer becomes packed herein. If this packing occurs, the developer between the electrodes 81 and 82 cannot circulates, and in this situation, the self weight of the developer, and/or the magnetic force, is not large enough to cause the packed developer to free fall from between the two electrodes, and therefore, the electrostatic capacity between the two electrodes 81 and 82 does not change, which makes it impossible to detect the developer amount. This phenomenon is most likely to occur under a highly humid ambience in which it is easier for the developer to absorb moisture.

Figure 17:
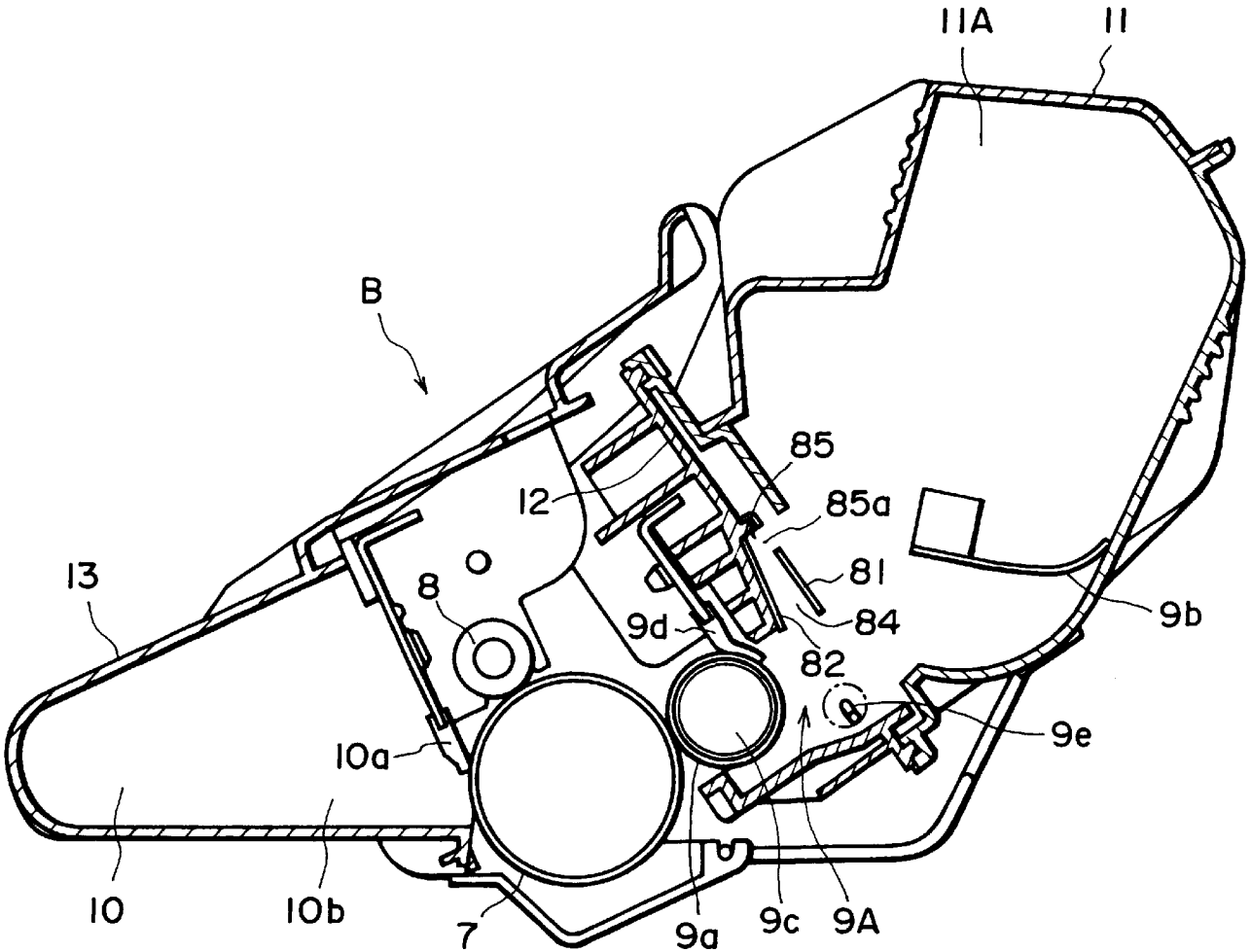
FIG. 17 is a vertical sectional view of the process cartridge in another embodiment of the present invention.

FIG. 17 depicts a structural configuration as a solution to the above described problem of developer packing, according to which an opening 85*a*, i.e., an exit, is provided, in addition to the opening 84, i.e., the entrance-exit, on the most inward side 85 of the gap between the electrodes 81 and 82, to allow the developer to pass between the electrodes 81 and 82, so that the developer which enters the gap between the two electrodes does not become packed therein.

Next, the structure for attaching the first and second electrodes 81 and 82 to the developing apparatus portion of the process cartridge B will be described.

The developer amount detecting portion 80 comprising the first and second electrodes 81 and 82 determines the developer amount by detecting the electrostatic capacity between the two electrodes 81 and 82. Therefore, the positional accuracy of the electrodes is extremely important. Further, since the primary object of the present invention is to accurately predict the time when toner depletion, which results in various while spots, occurs, the electrodes 81 and 82 should be positioned in the adjacency of the development roller 9*a* where the developer remains until it is depleted.

Figure 18:
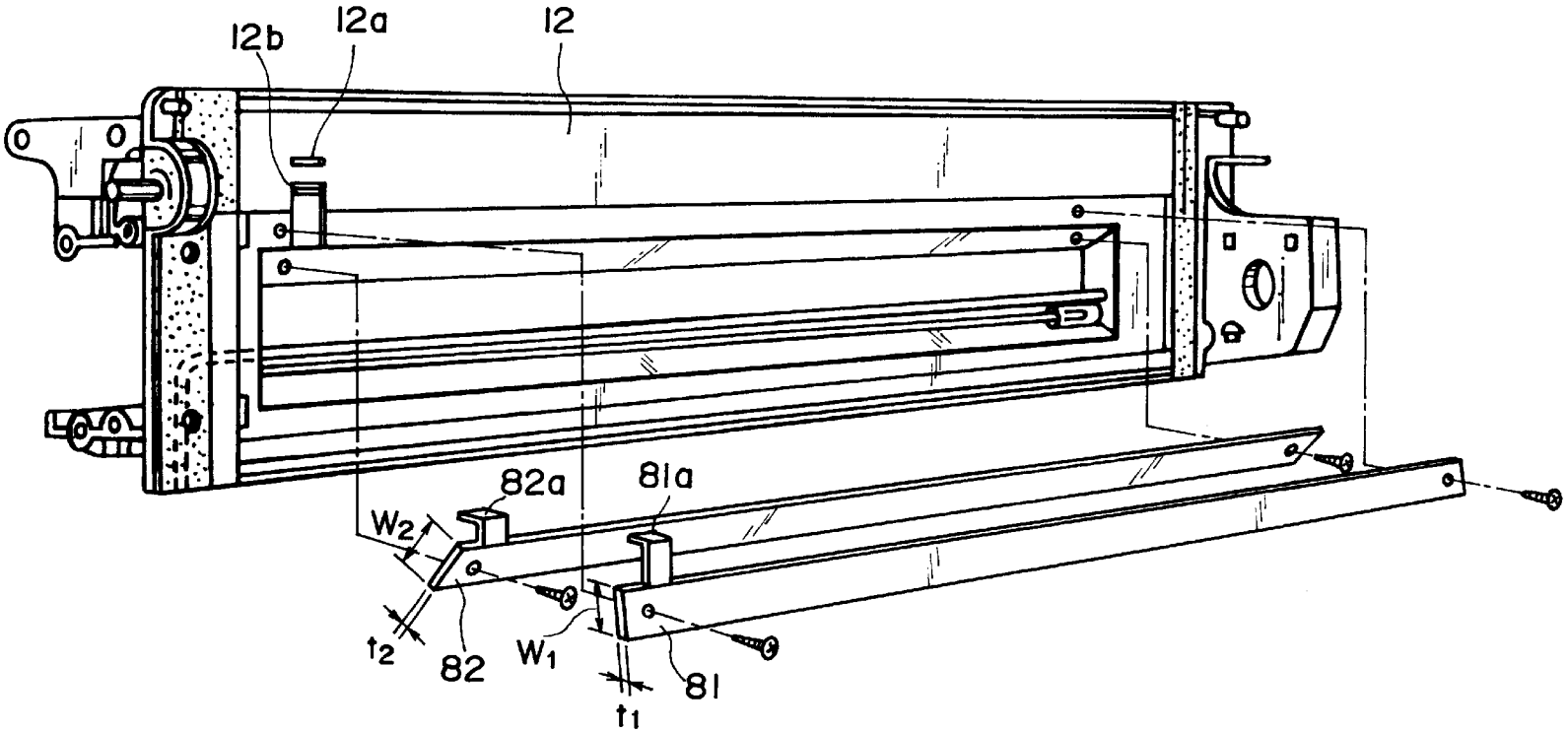
FIG. 18 is a perspective view of the development unit frame in the first embodiment of the present invention, and depicts how the first and second electrodes are attached to the development unit frame.

Thus, in this embodiment, the first and second electrodes 81 and 82 are attached to the development unit frame 12, as shown in FIG. 18. As for the means for attaching the first and second electrodes 81 and 82, screws, adhesive, crimping, insert molding, or the like, may be used. With the employment of the above described structural arrangement, the electrodes 81 and 82 can be accurately positioned so that the distance between the first and second electrodes 81 and 82 is precisely set. Further, the positioning of the first and second electrodes 81 and 82 in the adjacency of the development roller 9*a* makes it possible to very closely detect the time when the developer runs out.

The first and second electrodes 81 and 82 in this embodiment are formed, of nonmagnetic SUS, independently from the development unit frame 12, and then, are attached thereto with an appropriate means, as described above. However, the electrodes 81 and 82 may be directly formed on the development unit frame 12 with the use of such a process as vapor deposition or printing, or may be built into the development unit frame 12, as electrically conductive portions, with the use of a combination of electrically conductive resin and two color molding. Compared to the design in this embodiment in which the electrodes and development unit frame are manufactured independently from each other, these alternative designs are much smaller in terms of attachment error and/or component size error, and therefore, their employment can improves the positioning accuracy for the electrodes.

Figure 19:
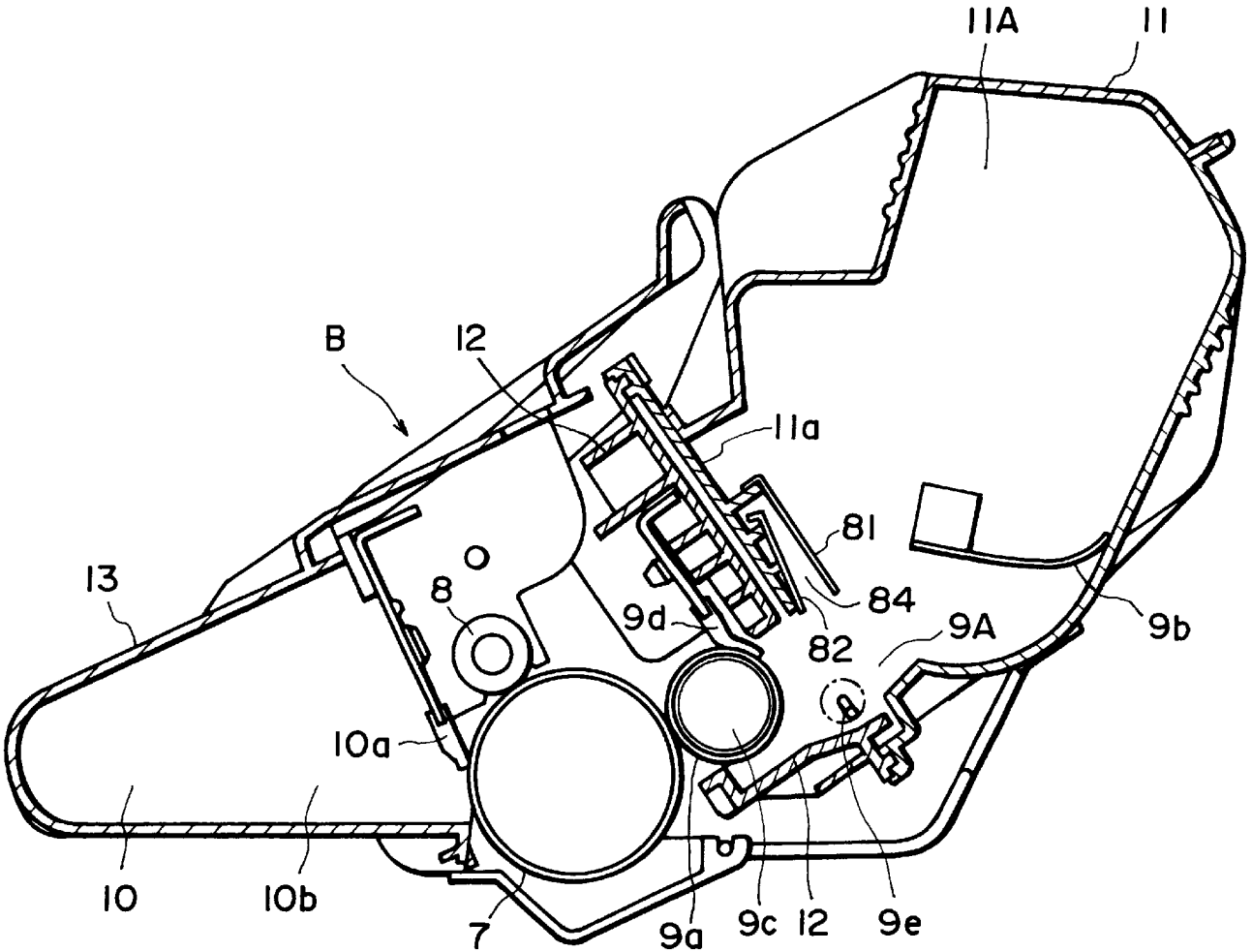
FIG. 19 is a vertical sectional view of the process cartridge in another embodiment of the present invention.

Further, when necessary, for example, in a case that the development unit frame 12 is small, the design of the process cartridge B may be modified so that the first and second electrodes 81 and 82 are attached to the front wall 11*a* of the developer container 11A, as shown in FIG. 19. In this case, the electrodes 81 and 82 can be accurately positioned.

Figure 20:
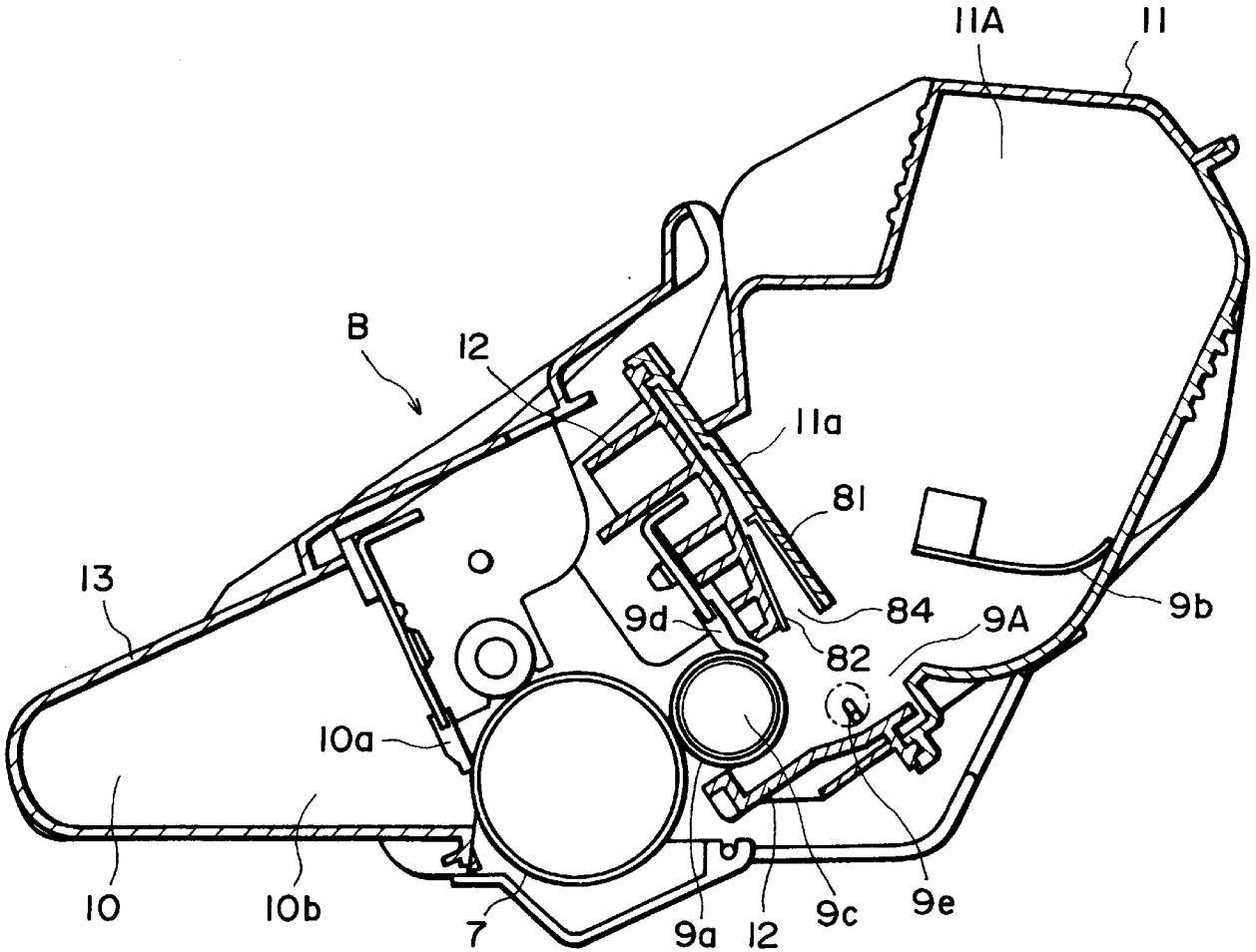
FIG. 20 is a vertical sectional view of the process cartridge in another embodiment of the present invention.
Figure 21:
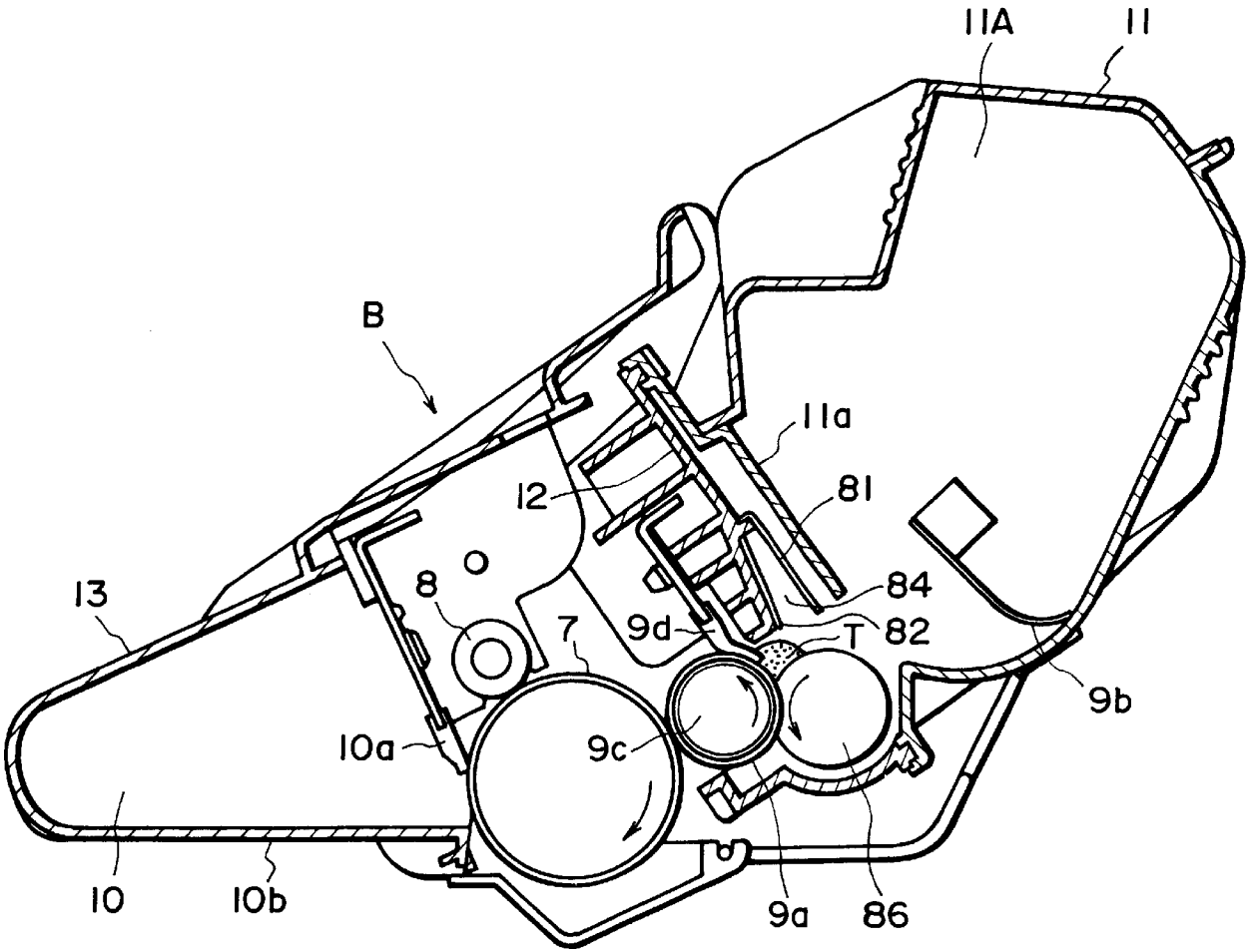
FIG. 21 is a vertical sectional view of the process cartridge in another embodiment of the present invention.

Further, the process cartridge B design may be modified as shown in FIG. 20. In this case, the second electrode 82 is attached to the development unit frame 12, and the first electrode 81 is attached to the front wall 11*a* of the developer container 11A, so that the first and second electrodes 81 and 82 oppose each other as the development unit frame 12 is joined with the developer container 11A. This arrangement affords more latitude in terms of the frame structure design for the process cartridge B.

In the preceding portions of this specification, the structural arrangement for continuously detecting the developer amount was described with reference to a case in which magnetic developer was used as the developer for the process cartridge B. However, the present invention is also applicable to various process cartridges comprising a developing apparatus portion which employs nonmagnetic developer.

In the case of a developing apparatus structure which employs nonmagnetic developer, a developer coating roller 86 is used as a means for supplying the development roller 9*a* with the developer. The roller 86 is an elastic member formed of sponge or the like, and is rotated in the counter direction to the development roller 9*a*, in contact with the development roller 9*a*. The developer is coated on the development roller 9*a* by the electrostatic force (measured in coulomb) generated by the contact. Immediately prior to the complete depletion of the developer T, the developer T remains above the interface between the development roller 9*a* and developer coating roller 86. Thus, positioning the first and second electrodes 81 and 82 in the adjacency of the area above this interface makes it possible to continuously detect the developer amount as in the process cartridge B which employs magnetic developer.

Figure 4:
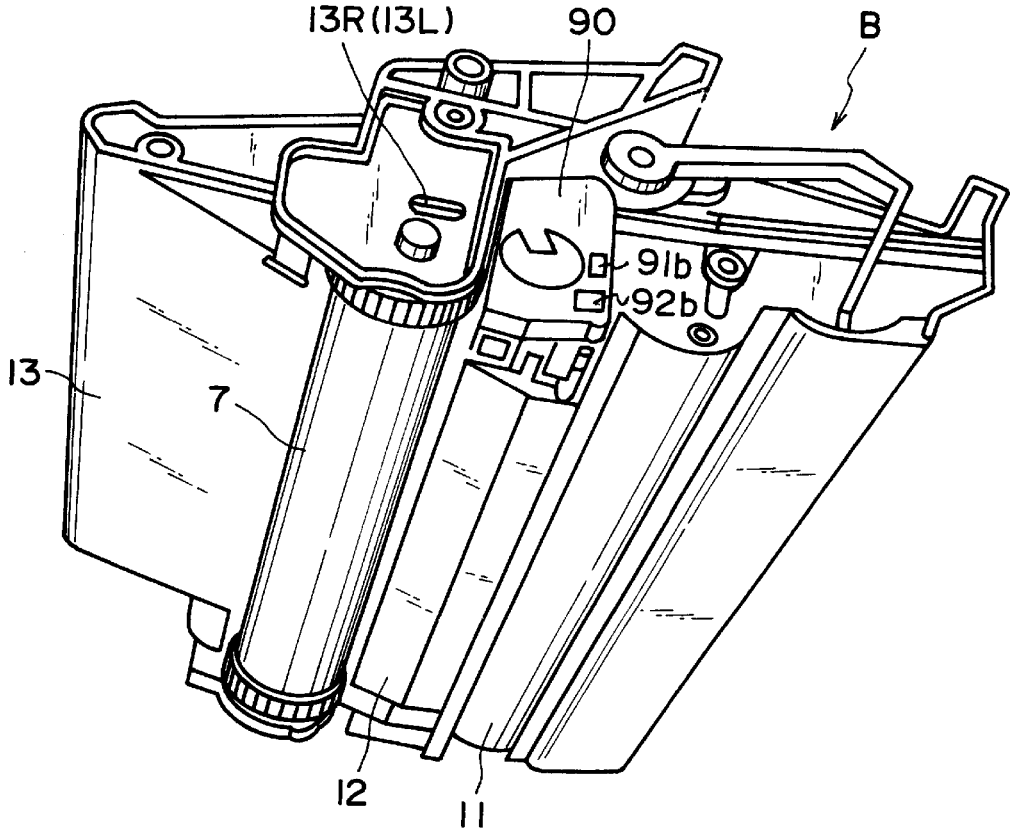
FIG. 4 is an external perspective view of the process cartridge in accordance with the present invention as seen from the bottom side.
Figure 5:
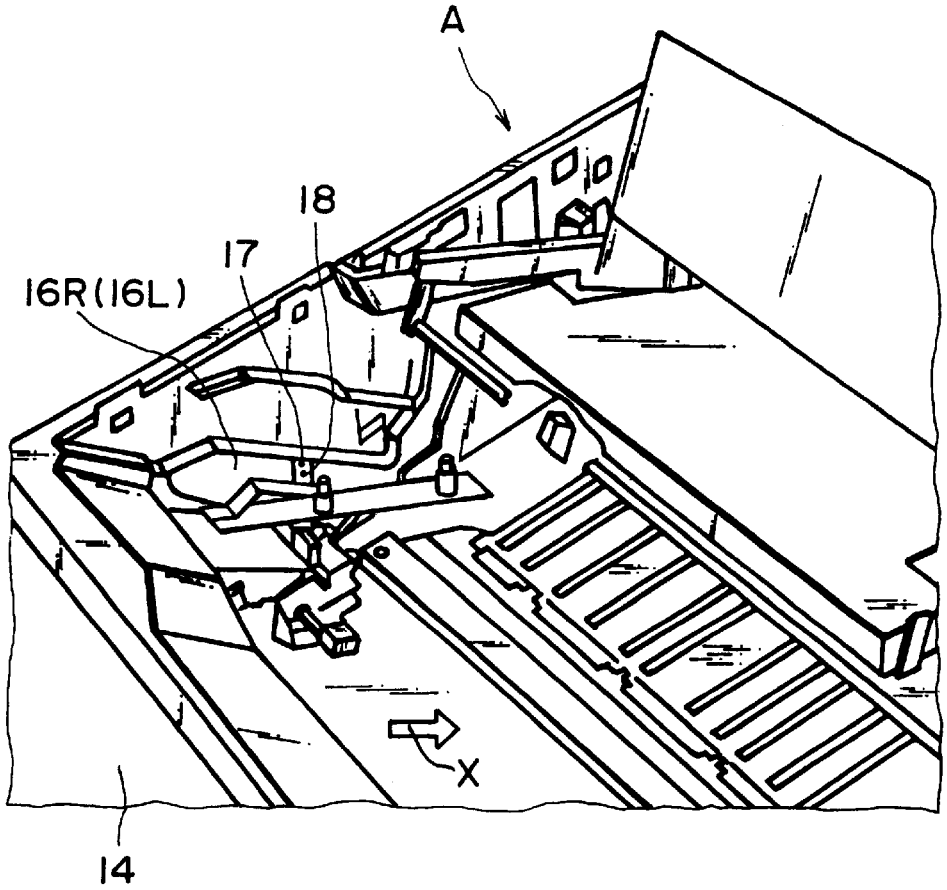
FIG. 5 is an external perspective view of the cartridge installation chamber in the main assembly of the process cartridge in accordance with the present invention.

Next, referring to FIGS. 4–6, this embodiment of the present invention will be described regarding the structural arrangement for connecting the electrodes 81 and 82 with the electrical contacts on the electrophotographic image forming apparatus main assembly 14 side.

Figure 6:
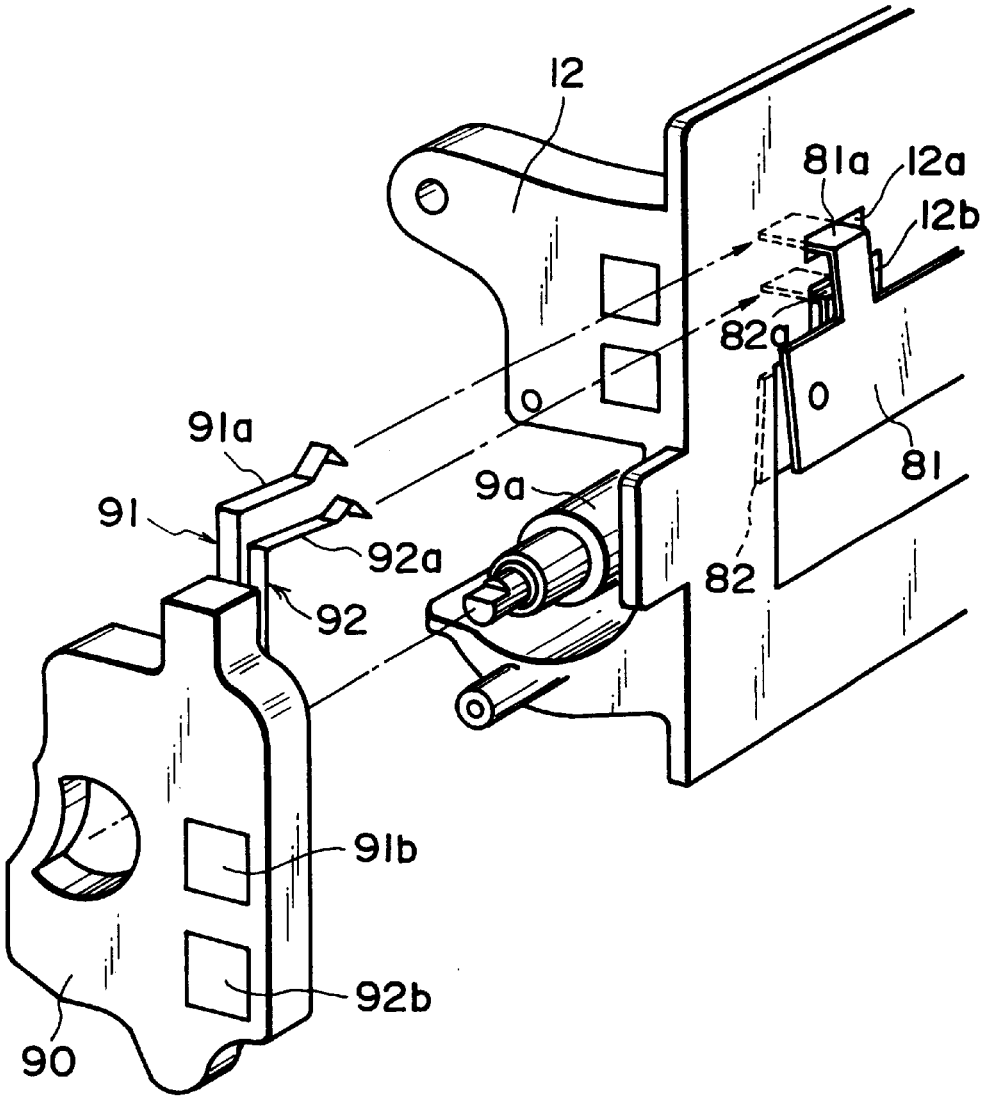
FIG. 6 is a perspective view of the partially disassembled development unit frame, and depicts an example of the structural configuration for connecting electrodes of the developer amount detecting apparatus in accordance with the present invention.

In this embodiment, the first and second electrodes 81 and 82 are provided with projections 81*a* and 82*a*, respectively, as shown in FIG. 6. These projections 81*a* and 82*a* are inserted in the corresponding through holes 12*a* and 12*b* with which the development unit frame 12 is provided, when the first and second electrodes 81 and 82 are attached to the development unit frame 12.

The development unit frame 12 is provided with a holder 90, which is fixed to the development unit frame 12, at one of the longitudinal end. The holder 90 rotatively supports the development roller 9*a* with the interposition of a bearing. The holder 90 is provided with a first electrical contact 91 and a second electrical contact 92. The contact portions 91*a* and 92*a*, that is, the free ends, of the first and second electrical contacts 91 and 92, respectively, become connected to the aforementioned projections 81*a* and 82*a* of the first and second electrodes 81 and 82, respectively, as the holder 90 is fixed to the development unit frame 12, at one of the longitudinal ends.

The contact portions 91*b* and 92*b*, that is, the ends opposite to the aforementioned free ends, of the first and second electrical contacts 91 and 92 are fixed to the holder 90, being exposed from the outward surface of the holder 90 so that, as the process cartridge B is installed into the apparatus main assembly 14, they become electrically connected to the contacts 17 and 18 (FIG. 5), respectively, positioned in the apparatus main assembly 14.

With the provision of the above described structural configuration, as the process cartridge B is installed into the main assembly 14 of an electrophotographic image forming apparatus, voltage is applied from the electrophotographic image forming apparatus main assembly 14 to the first electrode 81 through the first electrical contact 91, and the voltage induced in the second electrode 82, which is in accordance with the electrostatic capacity between the electrodes 81 and 82, is outputted to the electrophotographic image forming apparatus main assembly 14 through the second electrical contact 92. Of course, it is possible that voltage be applied from the electrophotographic image forming apparatus main assembly 14 to the second electrode 82 through the first electrical contact 92, and the voltage induced in the first electrode 81 be outputted to the electrophotographic image forming apparatus main assembly 14 through the second electrical contact 92.

Figure 22:
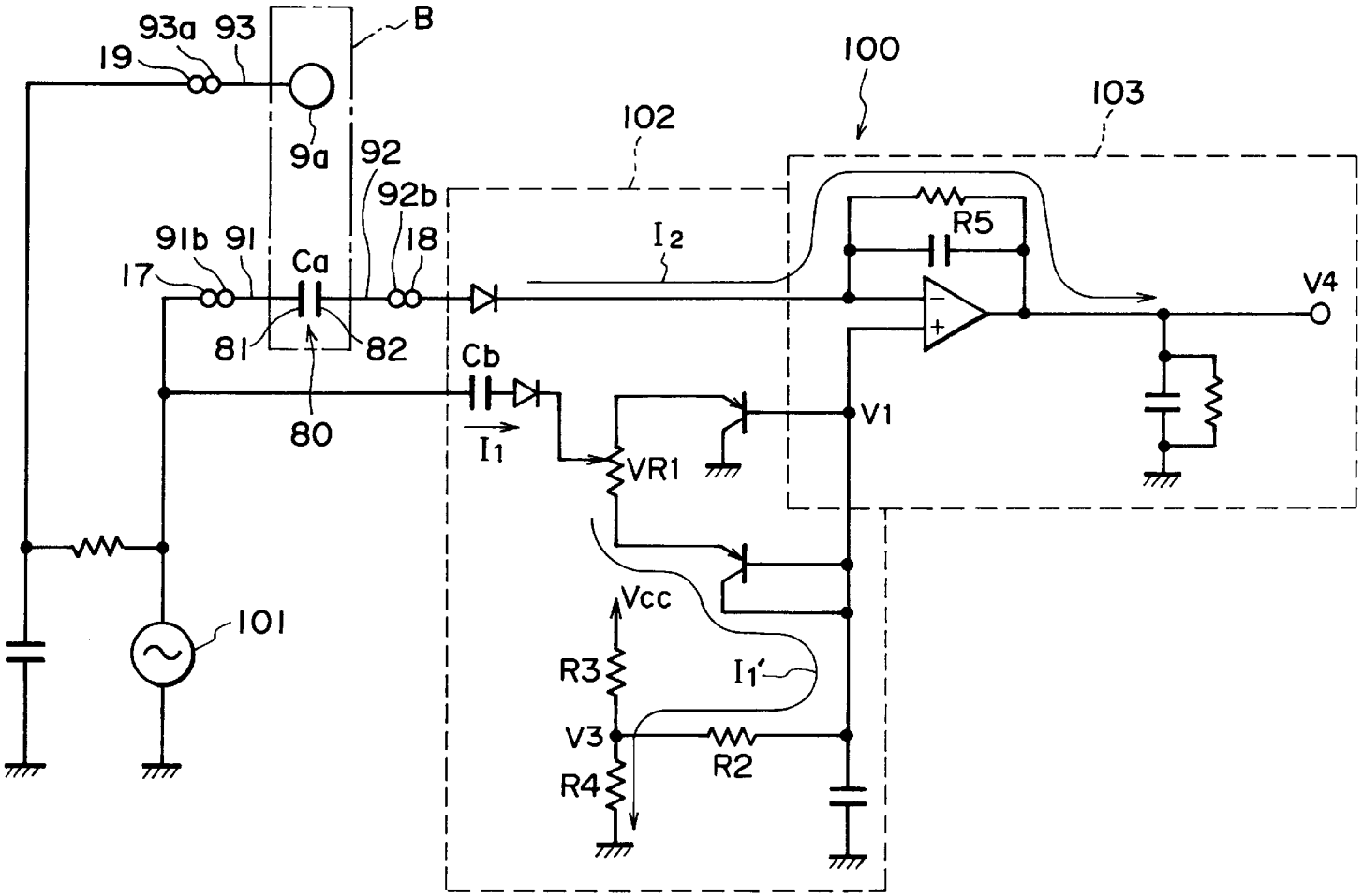
FIG. 22 is the diagram of the developer amount detection circuit for the developer amount detecting apparatus in the first embodiment of the present invention.

Next, referring to FIG. 22, an embodiment of the above described principle in the form of a developer amount detecting apparatus will be described further. FIG. 22 is an example of a diagram of a developer amount detection circuit, inclusive of the connection between the circuit and the developer amount detecting portion 80 provided with the first and second electrodes 81 and 82, in the image forming apparatus.

The detecting portion 80, which has an electrostatic capacity Ca which fluctuates in accordance with the change in the developer amount, comprises an input electrode as an impedance element, that is, the first electrode 81 in this embodiment, and an output electrode, that is, the second electrode 82 in this embodiment. The input electrode is connected to a development bias circuit 101, as a development bias applying means, through the first electrical contact 91, and the output electrode is connected to the control circuit 102 of the developer amount detection circuit 100 through the second electrical contact 92. A referential capacity element (Cb) is also connected to the development bias circuit 101, and establishes a reference voltage V1 for detecting the amount of the remaining developer, with the use of the AC current 11 applied through the bias circuit 101. It is obvious that, as the process cartridge B is installed into the apparatus main assembly 14, the contact 19 (unillustrated in FIG. 5) disposed in the apparatus main assembly 14 makes electrical contact with the contact portion 93*a* of the electrical contact 93 of the development roller 9*a*, and as a result, development bias is applied to the development roller 9*a* from the bias circuit 101.

The control circuit 102 establishes the reference voltage V1 by adding the amount V2 of the voltage drop caused by an AC current I1', that is, a current shunted by a volume VR1 from the AC current I1 applied to the reference impedance element, and a resistor R2, to voltage V3 established by resistors R3 and R4.

Therefore, an AC current 12 applied to the developer amount detecting portion 80 is inputted into an amplifier 103, and then, is outputted as a voltage V4 (V1−I2×R5) which represents the amount of the remaining developer. Then, its output value is used as the value of the detected amount of the remaining developer.

The image forming apparatus in this embodiment prompts a user to prepare a new process cartridge or a developer supply cartridge, by displaying the consumed amount of the developer determined based on the information obtained by continuously detecting the developer amount between the first and second electrodes 81 and 82, and also prompts a user to exchange the process cartridge, or replenish the process cartridge with a fresh supply of developer, by displaying "OUT OF DEVELOPER" in accordance with the detected depletion of the developer by the aforementioned continuous detection.

Figure 23:
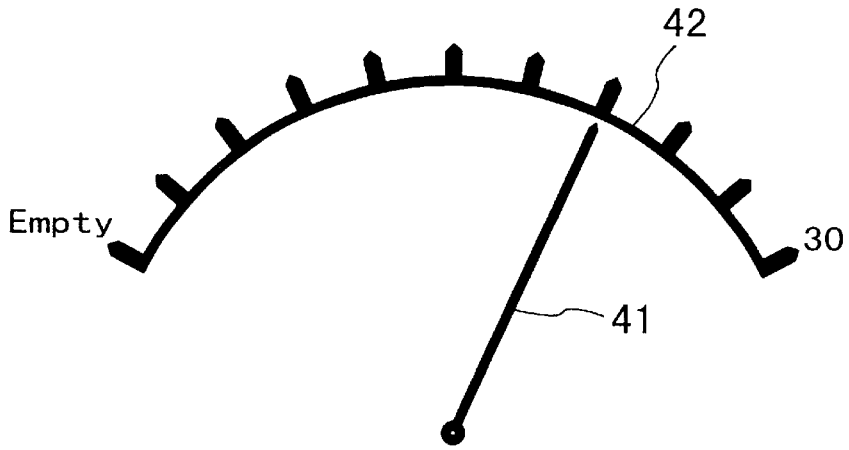
FIG. 23 is a schematic drawing of an example of a developer amount gauge.
Figure 24:
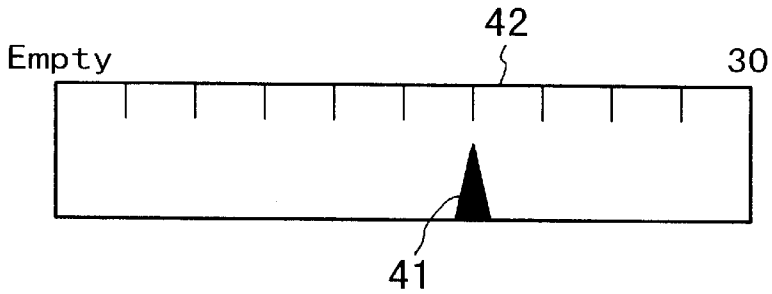
FIG. 24 is a schematic drawing of another example of a developer amount gauge.

Regarding the method for displaying the developer amount, the information obtained by the aforementioned developer amount detecting apparatus is displayed on the monitor screen of a user's personal computer or the like, as shown in FIGS. 23 and 24; a user is informed of the developer amount by observing the point on a gauge 42 indicated by a hand (needle) 41 which moves in accordance with the developer amount.

Figure 25:
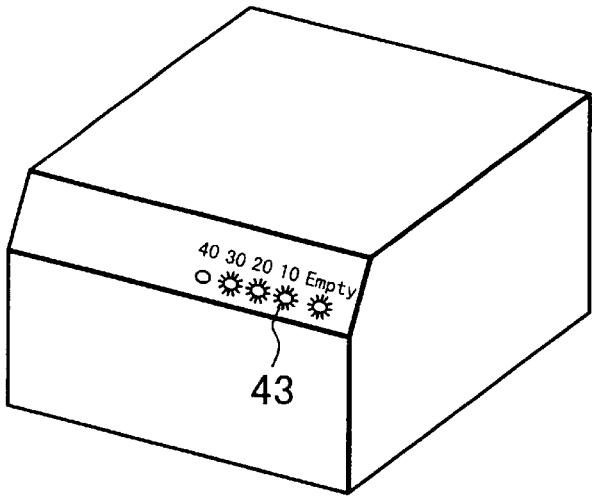
FIG. 25 is a vertical sectional view of the process cartridge in another embodiment of the present invention.

The image forming apparatus main assembly itself may be provided with a display panel, such as an LED based display panel 43 shown in FIG. 25, which flashes at a position correspondent to the developer amount.

Embodiment 2

Figure 26:
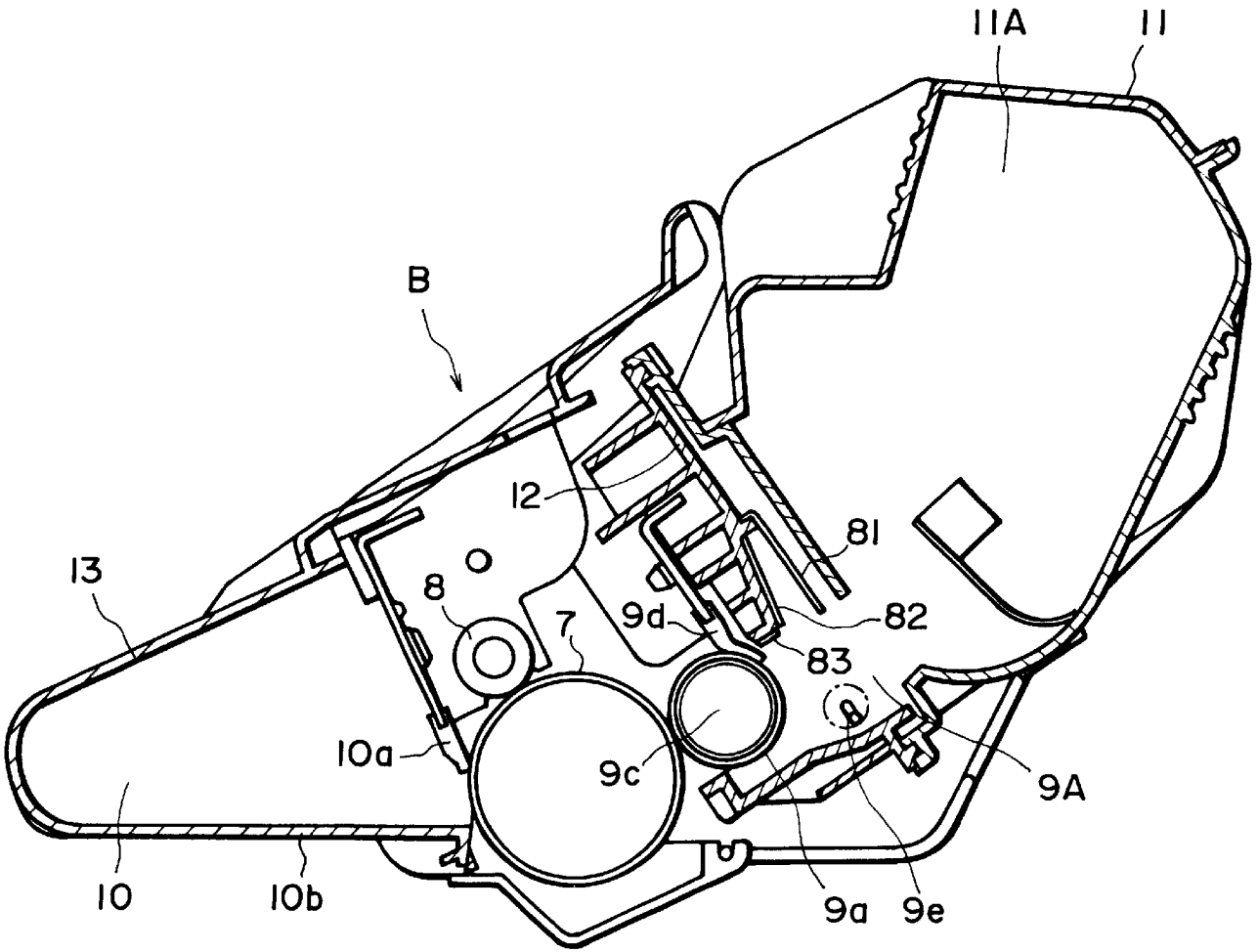
FIG. 26 is a longitudinal sectional view of a process cartridge according to an embodiment of the present invention.

FIG. 26 depicts another embodiment of the present invention. The developing apparatus in the process cartridge B in this embodiment is provided with a third electrically conductive portion (electrode) 83 as the measuring member for the developer amount detecting portion 80. Otherwise, it is substantially the same in structure as the one in the process cartridge B in the first embodiment. Thus, the structures and components in this embodiment, which are the same as those in the first embodiment, will be given the same reference numbers as those given to the corresponding structures and components in the first embodiment, and their detailed descriptions will be omitted.

In other words, this embodiment is a duplicate of the first embodiment in terms of the first and second electrically conductive portions (electrodes) 81 and 82, their structures and positioning, developer circulation between the electrodes 81 and 82, structures surrounding the electrodes 81 and 82, methods for attaching the electrodes 81 and 82, and the like. Therefore, the descriptions for the structures and functions of the duplicate portions will be omitted.

The primary object of the process cartridge structure in this embodiment is to accurately detect the point in time immediately before the printing errors in the form of white spots begin to be seen in finished prints. All that is necessary to accomplish this object is to detect the developer amount in the area in the process cartridge B, from which the last supply of the developer is consumed. Thus, in this embodiment, the developer amount in the immediate adjacencies of the second and third electrodes 82 and 83, and the development roller 9*a*, is detected as described in the description of the first embodiment, regarding the developer circulation.

In other words, in the case of the developer amount detecting apparatus in this embodiment, which is illustrated in FIG. 26, not only the first and second electrodes 81 and 82 are positioned as those in the first embodiment, but also, an additional electrodes, i.e., the third electrode 83, is positioned along the development roller 9*a*. The third electrode 83 is disposed much closer to the development roller 9*a* than the first electrode 83.

With the provision of the above described structural arrangement, as voltage is applied to the first electrode 81, static electricity is induced between the first and second electrodes 81 and 82 by an amount of Ca, and at the same time, static electricity is also induced between the development roller 9*a* and third electrode 83 by the development bias applied to the development roller 9*a*, by an amount of Cc. The development amount is determined by measuring these electrostatic capacities Ca and Cc.

Figure 27:
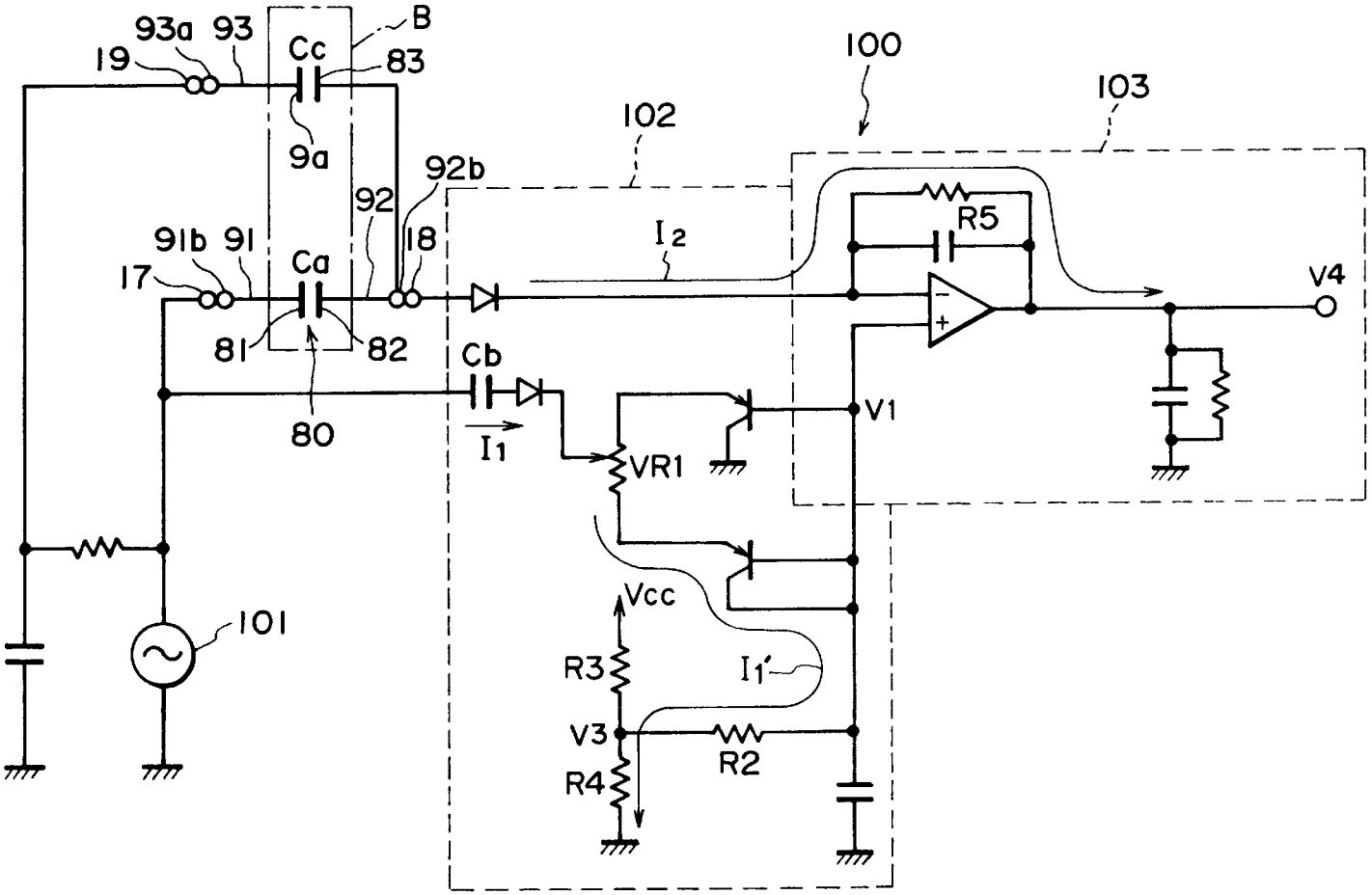
FIG. 27 is the diagram of the developer amount detection circuit for the developer amount detecting apparatus in the another embodiment of the present invention.

Illustrated In FIG. 27 is an example of a developer amount detection circuit in this embodiment. The overall circuit structure is substantially the same as the developer amount detection circuit in the first embodiment given in FIG. 22, with one exception that the third electrode 83 is disposed in a way to oppose the development roller 9*a* so that static electricity is induced between the development roller 9*a* and third electrode 83 by the amount of Cc. Therefore, the detailed description for this embodiment will be omitted.

Referring to FIG. 27, the developer amount detection circuit in this embodiment is provided with a contact 91 to be connected with the electrode 17 of the electrophotographic image forming apparatus main assembly 14 to apply voltage to the first electrode 81, and a contact 93 to be connected with the electrode 19 of the apparatus main assembly 14 to apply the development bias to the development roller 9*a*. The separate provision of these contacts 91 and 93 affords more latitude in design.

Further, the voltage to be applied to the first electrode 81 is provided from the development bias circuit 101, eliminating the need for an additional power source. Therefore, cost increase can be avoided.

Further, the contacts are in the form of a single piece, and therefore, there is no stray capacitance, assuring that the electrostatic capacity is accurately measured.

Figure 28:
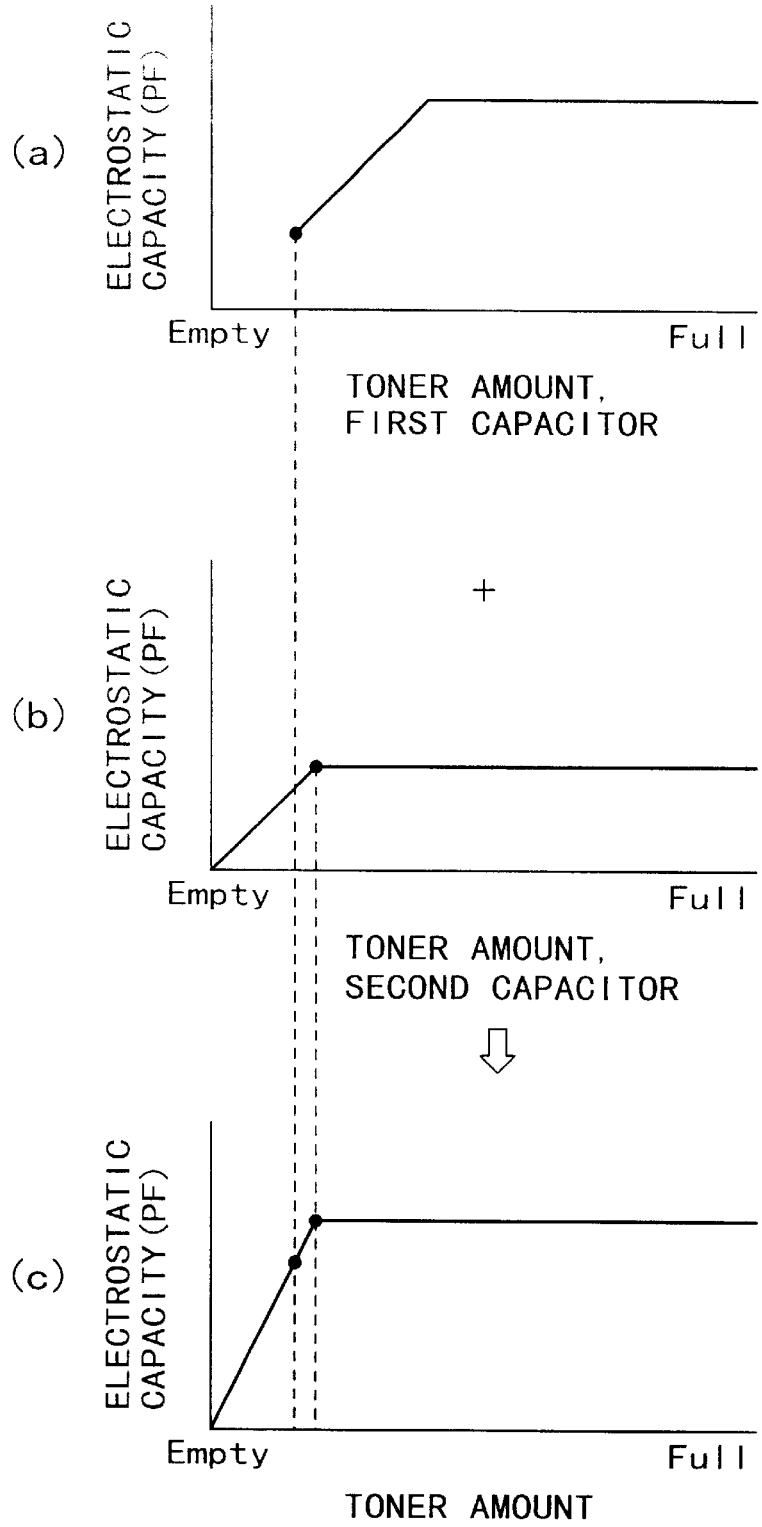
FIG. 28 is a graph which depicts the developer amount detection principle in accordance with the present invention.
Figure 29:
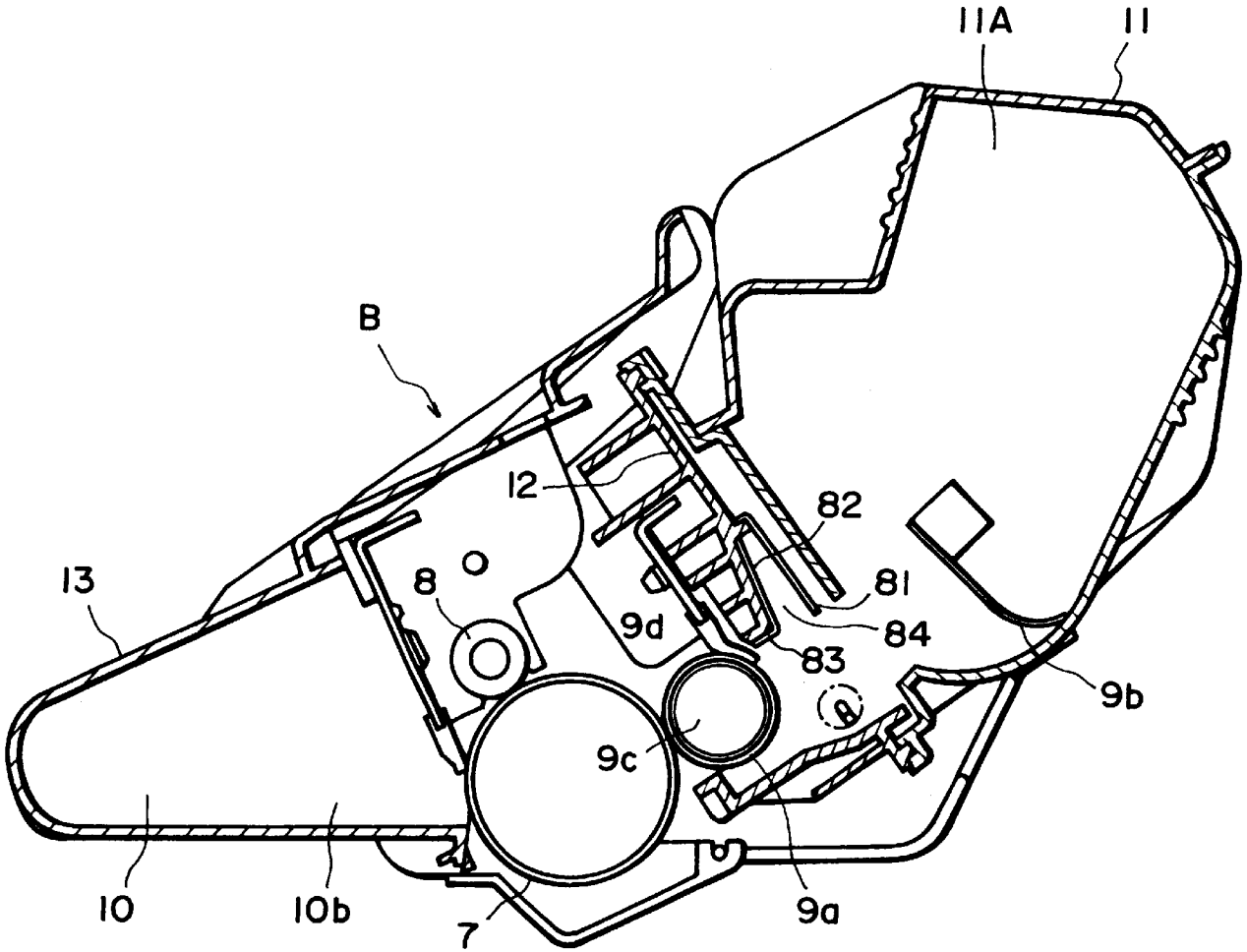
FIG. 29 is a vertical cross-sectional view of the process cartridge in another embodiment of the present invention.

As described above, in this embodiment, the developer amount in the process cartridge B is accurately determined by continuously detecting the decrease in the amount of the developer between the electrodes 81 and 82, and the "END" of the developer supply in the process cartridge B is accurately detected by detecting the amount of the developer between the development roller 9*a* and electrode 83. The relationship between the developer amount and the output of the toner amount detection circuit is graphically shown in FIGS. 28, (a), (b) and (c).

Again referring to FIG. 27, the first electrostatic capacity element (Ca) provided by the first and second electrodes 81 and 82, and the second electrostatic capacity element (Cc) provided by the development roller 9*a* and third electrode 83, are connected in parallel, reducing the number of the contacts in the image forming apparatus main assembly 14 and process cartridge B. Therefore, the process cartridge B in this embodiment is lower in cost.

Lengthy routing of wiring increases the chance that static electricity is induced between the adjacent portions of wiring, which in turns reduces detection accuracy. Thus, reducing the distance electric wiring is routed leads to improvement in detection accuracy. Therefore, the second and third electrodes 82 and 83 are desired to be wired as shown in FIG. 27. Preferably, the second and third electrodes 82 and 83 are integrally formed to minimize the wiring, so that detection accuracy is further improved. In this case, the third electrode 83 is bent so that the bent portion of the electrode 83 extends away from the second electrode 82, reducing the distance between the third electrode 83 and development roller 9*a* as described above.

Embodiment 3

Figure 30:
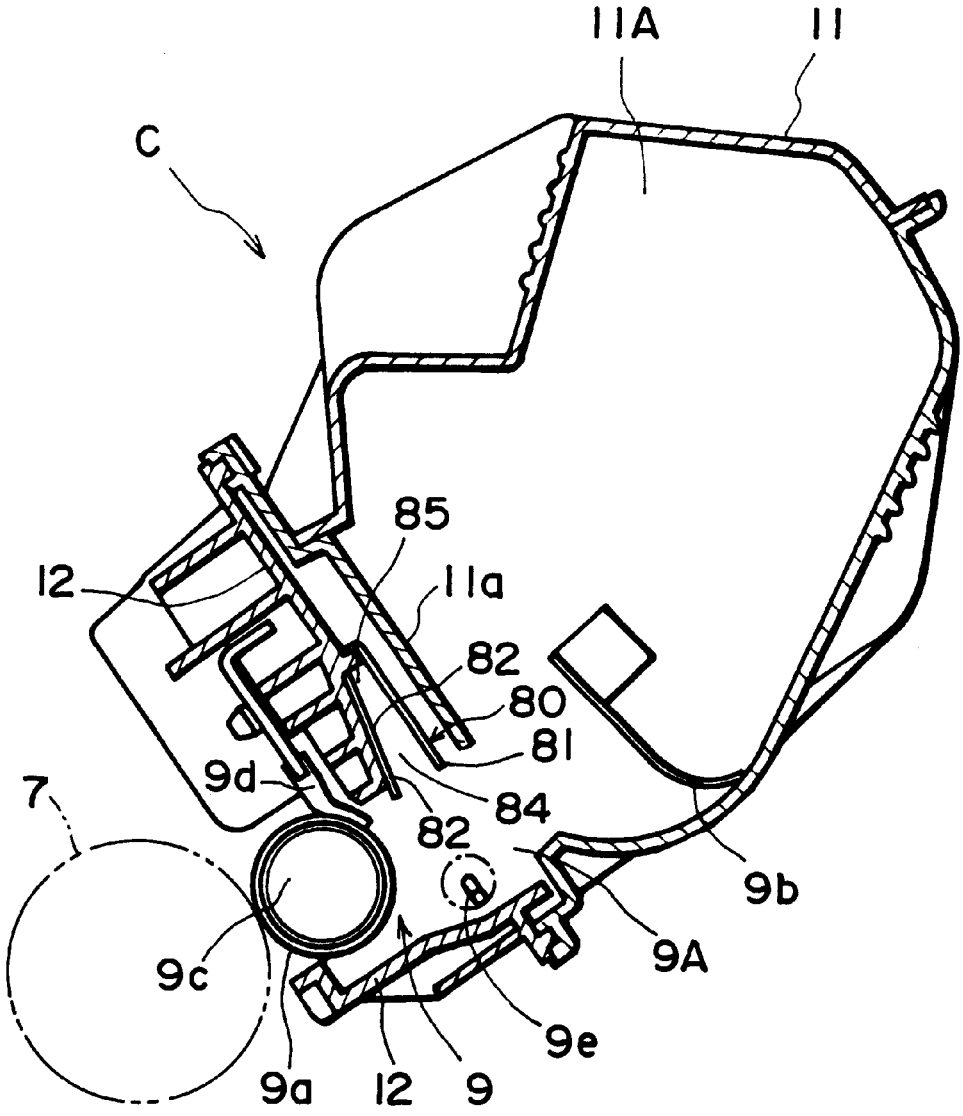
FIG. 30 is a vertical sectional view of an example of a developing apparatus equipped with the developer amount detecting apparatus in accordance with the present invention.

FIG. 30 depicts another embodiment of the present invention in the form of a developing apparatus cartridge C.

The developing apparatus C in this embodiment is in the form of a cartridge comprising a developer carrier such as a development roller 9*a*, a development chamber 9A which contains toner to supply the developer carrier with developer, and a plastic development unit frame 11 in which the developer carrier and development chamber 9A are contained. In other words, the developing apparatus C in this embodiment is considered to be a cartridge version of the developing apparatus portion of the process cartridge B in the first and second embodiment described above, that is, a cartridge formed by eliminating the photosensitive drum 7, charging means 8, and cleaning means 10, from the process cartridge B. Therefore, all the descriptions given to the structures of the developing apparatus portion and developer amount detecting means portion, in the first and second embodiments, also apply to the developing apparatus in this embodiment. Thus, the description of the structure and function of the developing apparatus in this embodiment will be omitted here, by referring to the preceding descriptions of the first and second embodiment.

Needless to say, the developing apparatus in this embodiment may be provided with the third electrode 83.

As is evident from the descriptions of the preceding embodiments, according to the present invention, the amount of the remaining developer can be accurately and continuously detected.

In the preceding embodiments, the amount of the remaining developer can be continuously detected while the amount of the remaining developer is in a range from approximately 30% down to 0%, provided that the entire amount of the developer contained in the developer container before a process cartridge is put to use for the first time is 100%. However, the application of the present invention does not need to be limited to the preceding embodiment. For example, modifications may be made so that the amount of the remaining developer in the developer container can be continuously detected in a range from 50% down to 0%, or from 40% down to 0%. It should be noted here that "0%" does not means a state of a process cartridge in which the developer has been completely depleted; it also includes another state of a process cartridge in which the amount of the developer in the process cartridge has decreased to a point close enough to disable the image forming apparatus to form images with a predetermined level of quality (development quality).

[Effects of Invention]

As described above, according to the first aspect of the present invention, a developing apparatus, a process cartridge, or an electrophotographic image forming apparatus, comprises: a first electrically conductive portion; a second electrically conductive portion opposing the first electrically conductive portion; a first electrical contact for receiving the voltage to be applied to the first electrically conductive portion, from the electrophotographic image forming apparatus main assembly; and a second electrical contact for transmitting to the electrophotographic image forming apparatus main assembly, electrical signals generated in accordance with the electrostatic capacity provided between the first and second electrically conductive portions as voltage is applied to the first electrically conductive portion, in order to enable the electrophotographic image forming apparatus main assembly to detect the amount of the remaining developer. According to the second aspect of the present invention, a developing apparatus, a process cartridge, and an electrophotographic image forming apparatus, comprises: a first electrically conductive portion; a second electrically conductive portion opposing the first electrically conductive portion; a first electrical contact for receiving the voltage to be applied to the first electrically conductive portion, from the electrophotographic image forming apparatus main assembly; a third electrically conductive portion for inducing static electricity between the developer carrying member and itself as voltage is applied to the third electrically conductive portion from the electrophotographic image forming apparatus main assembly; and a second electrical contact for transmitting to the electrophotographic image forming apparatus main assembly, compound electrical signals comprising electrical signals generated in accordance with the electrostatic capacity provided between the first and second electrically conductive portions as voltage is applied to the first electrically conductive portion, and electrical signals generated in accordance with the electrostatic capacity provided between the developer carrying member and third electrically conductive portion as voltage is applied to the developer carrying member, in order to enable the electrophotographic image forming apparatus main assembly to detect the amount of the remaining developer. Therefore, the amount of the remaining developer in the development chamber can be continuously detected as the developer is consumed. Further, the measurement errors, which occur when detecting the amount of the remaining developer on the basis of the fluctuation in the electrostatic capacity between two electrodes, in an unstable ambience, can be eliminated to reduce overall detection error. Therefore, a developing apparatus, a process cartridge, and an electrophotographic image forming apparatus, can be drastically improved in terms of convenience.

Also, according to the first aspect of the present invention, a development unit frame comprises: a portion for supporting a developer carrying member for conveying developer to an electrophotographic photosensitive member to develop an electrostatic latent image formed on the electrophotographic photosensitive member; a portion for supporting a regulating member which regulates the amount of the developer allowed to remain on the peripheral surface of the developer carrying member; a portion for supporting the first electrically conductive portion; and a portion for supporting the second electrically conductive portion in such a way that the second electrically conductive portion opposes the first electrically conductive portion supported by the first electrically conductive portion supporting portion. Also, according to the second aspect of the present invention, a development unit frame comprises: a portion for supporting a developer carrying member for conveying developer to an electrophotographic photosensitive member to develop an electrostatic latent image formed on the electrophotographic photosensitive member; a portion for supporting a regulating member which regulates the amount of the developer allowed to remain on the peripheral surface of the developer carrying member; a portion for supporting the first electrically conductive portion; and a portion for supporting the second electrically conductive portion in such a way that the second electrically conductive portion opposes the first electrically conductive portion supported by the first electrically conductive portion supporting portion; and a portion for supporting the third electrically conductive portion in such a way that the third electrically conductive portion opposes the developer carrying member supported by the developer carrying member supporting portion. Therefore, it is assured that a developer amount detecting means or the like, which can continuously detect the amount of the developer remaining in the development chamber as the developer is consumed, is properly attached to the aforementioned developing apparatus, process cartridge, or electrophotographic image forming apparatus.

As is evident from the above description of the preferred embodiments of the present invention, according to the present invention, it is assured that the amount of the remaining developer can be continuously detected.

While the invention has been described with reference to the structures disclosed herein, it is not confined to the details set forth and this application is intended to cover such modifications or changes as may come within the purposes of the improvements or the scope of the following claims.

What is claimed is:

1. A developing device for developing an electrostatic latent image formed on an electrophotographic photosensitive member, said developing device being mountable to a main assembly of an electrophotographic image forming apparatus, said developing device comprising:

a developer carrying member for feeding a developer to the electrophotographic photosensitive member to develop the electrostatic latent image formed on the electrophotographic photosensitive member;

a first electroconductive portion;

a second electroconductive portion having a first portion for cooperating with said first electroconductive portion to provide an electrostatic capacity, wherein said first electroconductive portion and said second electroconductive portion are disposed in such a region that the developer is capable of entering between them, and wherein said second electroconductive portion has a second portion in which an electrostatic capacity is provided between said second portion of said second electroconductive portion and said developer carrying member;

a first electrical contact for receiving a voltage to be applied to said first electroconductive portion from the main assembly of the electrophotographic image forming apparatus;

a developer carrying member electrical contact for receiving a voltage to be applied to said developer carrying member from the main assembly of the electrophotographic image forming apparatus; and a second electrical contact for transmitting, to the main assembly of the electrophotographic image forming apparatus, an electric signal corresponding to an electrostatic capacity between said first electroconductive portion and said first portion of said second electroconductive portion when a voltage is applied to said first electroconductive portion through said first electrical contact and corresponding also to an electrostatic capacity between said developer carrying member and said second portion of said second electroconductive portion when a voltage is applied to said developer carrying member through said developer carrying member electrical contact, to detect in substantially real time the remaining amount of the developer by the main assembly of the electrophotographic image forming apparatus.

2. A device according to claim 1, wherein said second electrical contact has one end portion which is bent toward said developer carrying member, and the electrostatic capacity is provided between the bent portion and said developer carrying member.

3. A process cartridge according to claim 1, wherein a voltage to be applied to said developing carrying member is equal to a voltage to be applied to said first electroconductive portion.

4. A developing device for developing an electrostatic latent image formed on an electrophotographic photosensitive member, said developing device being mountable to a main assembly of an electrophotographic image forming apparatus, said developing device comprising:

a developer carrying member for feeding a developer to the electrophotographic photosensitive member to develop the electrostatic latent image formed on the electrophotographic photosensitive member;

a first electroconductive portion;

a second electroconductive portion for cooperating with said first electroconductive portion to provide an electrostatic capacity, wherein said first electroconductive portion and said second electroconductive portion are disposed in such a region that the developer is capable of entering between them;

a first electrical contact for receiving a voltage to be applied to said first electroconductive portion from the main assembly of the electrophotographic image forming apparatus;

a developer carrying member electrical contact for receiving a voltage to be applied to said developer carrying member from the main assembly of the electrophotographic image forming apparatus;

a third electroconductive portion for cooperating with said developer carrying member to provide an electrostatic capacity when a voltage is applied to said developer carrying member from the main assembly of said electrophotographic image forming apparatus; and a second electrical contact for transmitting, to the main assembly of the electrophotographic image forming apparatus, a combined electric signal, for permitting the main assembly of the electrophotographic image forming apparatus to detect the remaining amount of the developer in substantially real time, of an electric signal corresponding to an electrostatic capacity between said first electroconductive portion and said second electroconductive portion when a voltage is applied to said first electroconductive portion through said first electrical contact and an electric signal corresponding to an electrostatic capacity between said developer carrying member and the third electroconductive portion when a voltage is applied to said developer carrying member through said developer carrying member electrical contact, to detect the remaining amount of the developer by the main assembly of the electrophotographic image forming apparatus.

5. A device according to claim 1 or 4, wherein said first electroconductive portion and second electroconductive portion are arranged in a longitudinal direction of said developer carrying member which is in the form of a developing roller, wherein said first electroconductive portion is disposed more remote from said developer carrying member than said second electroconductive portion.

6. A device according to claim 1 or 4, wherein the developer fed between said first electroconductive portion and second electroconductive portion passes between said first electroconductive portion and second electroconductive portion.

7. A device according to claim 4, wherein said gap between said first electroconductive portion and said second electroconductive portion is wider at a developer entering side.

8. A device according to claim 1 or 4, further comprising a magnet disposed in said developer carrying member, and said developer is a magnetic developer which is deposited on the surface of said developer carrying member.

9. A developing device for developing an electrostatic latent image formed on an electrophotographic photosensitive member, said developing device being mountable to a main assembly of an electrophotographic image forming apparatus, said developing device comprising:

a developer carrying member for feeding a developer to the electrophotographic photosensitive member to develop the electrostatic latent image formed on the electrophotographic photosensitive member;

a first electroconductive portion;

a second electroconductive portion for cooperating with said first electroconductive portion to provide an electrostatic capacity;

a first electrical contact for receiving a voltage to be applied to said first electroconductive portion from the main assembly of the electrophotographic image forming apparatus; and a second electrical contact for transmitting, to the main assembly of the electrophotographic image forming apparatus, an electric signal corresponding to an electrostatic capacity between said first electroconductive portion and said second electroconductive portion when a voltage is applied to said first electroconductive portion to detect the remaining amount of the developer by the main assembly of the electrophotographic image forming apparatus, wherein the developer is fed between said first electroconductive portion and said second electroconductive portion, and the developer fed between said first electroconductive portion and said second electroconductive portion is retracted in a direction toward an entering side.

10. A developing device for developing an electrostatic latent image formed on an electrophotographic photosensitive member, said developing device being mountable to a main assembly of an electrophotographic image forming apparatus, said developing device comprising:

a developer carrying member for feeding a developer to the electrophotographic photosensitive member to develop the electrostatic latent image formed on the electrophotographic photosensitive member;

a first electroconductive portion;

a second electroconductive portion for cooperating with said first electroconductive portion to provide an electrostatic capacity;

a first electrical contact for receiving a voltage to be applied to said first electroconductive portion from the main assembly of the electrophotographic image forming apparatus;

a third electroconductive portion for cooperating with said developer carrying member to provide an electrostatic capacity when a voltage is applied to said developer carrying member from the main assembly of the electrophotographic image forming apparatus; and a second electrical contact for transmitting, to the main assembly of the electrophotographic image forming apparatus, a combined electric signal of an electric signal corresponding to an electrostatic capacity between said first electroconductive portion and said second electroconductive portion when a voltage is applied to said first electroconductive portion and an electric signal corresponding to an electrostatic capacity between said developer carrying member and the third electroconductive portion when a voltage is applied to said developer carrying member, to detect the remaining amount of the developer by the main assembly of the electrophotographic image forming apparatus, wherein said first electroconductive portion and second electroconductive portion have a flat-plate-like shape, and the gap between said first electroconductive portion and second electroconductive portion is wider at a developer entering side.

11. A device according to any one of claim 4 or 10, wherein said third electroconductive portion is constituted integrally with said second electroconductive portion.

12. A process cartridge according to claim 11, wherein said third electroconductive portion is at an angle relative to said second electroconductive portion.

13. A device according to claim 12, wherein said third electroconductive portion is disposed opposed to said developer carrying member, and wherein said third electroconductive portion is disposed closer to said developer carrying member than said first electroconductive portion and said second electroconductive portion.

14. A process cartridge detachably mountable to a main assembly of an electrophotographic image forming apparatus, said process cartridge comprising:

(a) an electrophotographic photosensitive member; and (b) a developing device for developing an electrostatic latent image formed on said electrophotographic photosensitive member, said developing device including:

a developer carrying member for feeding a developer to said electrophotographic photosensitive member to develop the electrostatic latent image formed on said electrophotographic photosensitive member;

a first electroconductive portion;

a second electroconductive portion having a first portion for cooperating with said first electroconductive portion to provide an electrostatic capacity, wherein said first electroconductive portion and said second electroconductive portion are disposed in such a region that the developer is capable of entering between them, and wherein said second electroconductive portion has a second portion in which an electrostatic capacity is provided between said second portion of said second electroconductive portion and said developer carrying member;

a first electrical contact for receiving a voltage to be applied to said first electroconductive portion from the main assembly of the electrophotographic image forming apparatus;

a developer carrying member electrical contact for receiving a voltage to be applied to said developer carrying member from the main assembly of the electrophotographic image forming apparatus; and a second electrical contact for transmitting, to the main assembly of the electrophotographic image forming apparatus, an electric signal corresponding to an electrostatic capacity between said first electroconductive portion and said first portion of said second electroconductive portion when a voltage is applied to said first electroconductive portion through said first electrical contact and corresponding also to an electrostatic capacity between said developer carrying member and said second portion of said second electroconductive portion when a voltage is applied to said developer carrying member through said developer carrying member electrical contact, to detect in substantially real time the remaining amount of the developer by the main assembly of the electrophotographic image forming apparatus.

15. A process cartridge according to claim 14, wherein said second electrical contact has one end portion which is bent toward said developer carrying member, and the electrostatic capacity is provided between the bent portion and said developer carrying member.

16. A process cartridge detachably mountable to a main assembly of an electrophotographic image forming apparatus, said process cartridge comprising:

(a) a electrophotographic photosensitive member; and (b) a developing device for developing a electrostatic latent image formed on said electrophotographic photosensitive member, said developing device including:

a developer carrying member for feeding a developer to said electrophotographic photosensitive member to develop the electrostatic latent image formed on said electrophotographic photosensitive member;

a first electroconductive portion;

a second electroconductive portion for cooperating with said first electroconductive portion to provide an electrostatic capacity, wherein said first electroconductive portion and said second electroconductive portion are disposed in such a region that the developer is capable of entering between them;

a first electrical contact for receiving a voltage to be applied to said first electroconductive portion from the main assembly of the electrophotographic image forming apparatus;

a developer carrying member electrical contact for receiving a voltage to be applied to said developer carrying member from the main assembly of the electrophotographic image forming apparatus;

a third electroconductive portion for cooperating with said developer carrying member to provide an electrostatic capacity when a voltage is applied to said developer carrying member from the main assembly of the electrophotographic image forming apparatus; and a second electrical contact for transmitting, to the main assembly of the electrophotographic image forming apparatus, a combined electric signal, for permitting the main assembly of the electrophotographic image forming apparatus to detect the remaining amount of the developer in substantially real time, of an electric signal corresponding to an electrostatic capacity between said first electroconductive portion and said second electroconductive portion when a voltage is applied to said first electroconductive portion through said first electrical contact and an electric signal corresponding to an electrostatic capacity between said developer carrying member and the third electroconductive portion when a voltage is applied to said developer carrying member through said developer carrying member electrical contact, to detect the remaining amount of the developer by the main assembly of the electrophotographic image forming apparatus.

17. A process cartridge according to claim 14 or 16, wherein said first electroconductive portion and second electroconductive portion are arranged in a longitudinal direction of said developer carrying member which is in the form of a developing roller, and wherein said first electroconductive portion is disposed more remote from said developer carrying member than said second electroconductive portion.

18. A process cartridge according to claim 14 or 16, wherein the developer fed between said first electroconductive portion and second electroconductive portion passes between said first electroconductive portion and second electroconductive portion.

19. A process cartridge according to claim 16, wherein the gap between said first electroconductive portion and second electroconductive portion is wider at a developer entering side.

20. A process cartridge according to claim 14 or 16, further comprising a magnet disposed in said developer carrying member, and said developer is a magnetic developer which is deposited on the surface of said developer carrying member.

21. A process cartridge detachably mountable to a main assembly of an electrophotographic image forming apparatus, said process cartridge comprising:

(a) an electrophotographic photosensitive member; and (b) a developing device for developing an electrostatic latent image formed on said electrophotographic photosensitive member, said developing device including:

a developer carrying member for feeding a developer to said electrophotographic photosensitive member to develop the electrostatic latent image formed on said electrophotographic photosensitive member;

a first electroconductive portion;

a second electroconductive portion for cooperating with said first electroconductive portion to provide an electrostatic capacity;

a first electrical contact for receiving a voltage to be applied to said first electroconductive portion from the main assembly of the electrophotographic image forming apparatus; and a second electrical contact for transmitting, to the main assembly of the electrophotographic image forming apparatus, an electric signal corresponding to an electrostatic capacity between said first electroconductive portion and said second electroconductive portion when a voltage is applied to said first electroconductive portion to detect the remaining amount of the developer by the main assembly of the electrophotographic image forming apparatus, wherein the developer is fed between said first electroconductive portion and said second electroconductive portion, and the developer fed between said first electroconductive portion and said second electroconductive portion is retracted in a direction toward an entering side.

22. A process cartridge detachably mountable to a main assembly of an electrophotographic image forming apparatus, said process cartridge comprising:

(a) an electrophotographic photosensitive member; and (b) a developing device for developing an electrostatic latent image formed on said electrophotographic photosensitive member, said developing device including:

a developer carrying member for feeding a developer to said electrophotographic photosensitive member to develop the electrostatic latent image formed on said electrophotographic photosensitive member;

a first electroconductive portion;

a second electroconductive portion for cooperating with said first electroconductive portion to provide an electrostatic capacity;

a first electrical contact for receiving a voltage to be applied to said first electroconductive portion from the main assembly of the electrophotographic image forming apparatus;

a third electroconductive portion for cooperating with said developer carrying member to provide an electrostatic capacity when a voltage is applied to said developer carrying member from the main assembly of the electrophotographic image forming apparatus; and a second electrical contact for transmitting, to the main assembly of the electrophotographic image forming apparatus, a combined electric signal of an electric signal corresponding to an electrostatic capacity between said first electroconductive portion and said second electroconductive portion when a voltage is applied to said first electroconductive portion and an electric signal corresponding to an electrostatic capacity between said developer carrying member and the third electroconductive portion when a voltage is applied to said developer carrying member, to detect a remaining amount of the developer by the main assembly of the electrophotographic image forming apparatus, wherein said first electroconductive portion and second electroconductive portion have a flat-plate-like shape, and the gap between said first electroconductive portion and second electroconductive portion is wider at a developer entering side.

23. A process cartridge according to any one of claim 14 or 22, wherein said third electroconductive portion is constituted integrally with said second electroconductive portion.

24. A process cartridge according to claim 23, wherein said third electroconductive portion is at an angle relative to said electroconductive portion.

25. A process cartridge according to claim 24, wherein said third electroconductive portion is disposed opposed to said developer carrying member, and wherein said third electroconductive portion is disposed closer to said developer carrying member than said first electroconductive portion and said second electroconductive portion.

26. An electrophotographic image forming apparatus for forming an image on a recording material, comprising:

(a) an electrophotographic photosensitive member;

(b) an electrostatic latent image forming means for forming an electrostatic latent image on said electrophotographic photosensitive member;

(c) a developing device for developing an electrostatic latent image formed on said electrophotographic photosensitive member, said developing device including:

a developer carrying member for feeding a developer to said electrophotographic photosensitive member to develop the electrostatic latent image formed on said electrophotographic photosensitive member;

a first electroconductive portion;

a second electroconductive portion having a first portion for cooperating with said first electroconductive portion to provide an electrostatic capacity, wherein said first electroconductive portion and said second electroconductive portion are disposed in such a region that the developer is capable of entering between them, and wherein said second electroconductive portion has a second portion in which an electrostatic capacity is provided between said second portion of said second electroconductive portion and said developer carrying member;

a first electrical contact for receiving a voltage to be applied to said first electroconductive portion from a main assembly of said electrophotographic image forming apparatus;

a developer carrying member electrical contact for receiving a voltage to be applied to said developer carrying member from the main assembly of said electrophotographic image forming apparatus; and a second electrical contact for transmitting, to the main assembly of said electrophotographic image forming apparatus, an electric signal corresponding to an electrostatic capacity between said first electroconductive portion and said first portion of said second electroconductive portion when a voltage is applied to said first electroconductive portion through said first electrical contact and corresponding also to an electrostatic capacity between said developer carrying member and said second portion of said second electroconductive portion when a voltage is applied to said developer carrying member through said developer carrying member electrical contact, to detect in substantially real time the remaining amount of the developer existing in said developing device by the main assembly of said electrophotographic image forming apparatus; and (d) detecting means for detecting in substantially real time the amount of a developer existing in said developing device on the basis of the electric signal transmitted from said second electrical contact.

27. An electrophotographic image forming apparatus for forming an image on a recording material, comprising:

electrophotographic photosensitive member;

electrostatic latent image forming means for forming an electrostatic latent image on said electrophotographic photosensitive member;

a developer carrying member for feeding a developer to said electrophotographic photosensitive member to develop the electrostatic latent image formed on said electrophotographic photosensitive member;

first electroconductive portion;

a second electroconductive portion for cooperating with said first electroconductive portion to provide an electrostatic capacity, wherein said first electroconductive portion and said second electroconductive portion are disposed in such a region that the developer is capable of entering between them;

a first electrical contact for receiving a voltage to be applied to said first electroconductive portion from a main assembly of the electrophotographic image forming apparatus;

a developer carrying member electrical contact for receiving a voltage to be applied to said developer carrying member from the main assembly of said electrophotographic image forming apparatus;

a third electroconductive portion for cooperating with said developer carrying member to provide an electrostatic capacity when a voltage is applied to said developer carrying member from the main assembly of said electrophotographic image forming apparatus;

a second electrical contact for transmitting, to the main assembly of said electrophotographic image forming apparatus, a combined electric signal of an electric signal corresponding to an electrostatic capacity between said first electroconductive portion and said second electroconductive portion when a voltage is applied to said first electroconductive portion through said first electrical contact and an electric signal corresponding to an electrostatic capacity between said developer carrying member and the third electroconductive portion when a voltage is applied to said developer carrying member through said developer carrying member electrical contact, to detect the remaining amount of the developer in a process cartridge detachably mountable on said electrophotographic image forming apparatus by the main assembly of said electrophotographic image forming apparatus; and detecting means for detecting in substantially real time the amount of a developer existing in the process cartridge on the basis of the electric signal transmitted from said second electrical contact.

28. An electrophotographic image forming apparatus for forming an image on a recording material, to which a process cartridge is detachably mountable, said apparatus comprising:

(a) mounting means for detachably mounting the process cartridge, which includes:

an electrophotographic photosensitive member; and a developing device for developing an electrostatic latent image formed on the electrophotographic photosensitive member, the developing device including:

a developer carrying member for feeding a developer to the electrophotographic photosensitive member to develop the electrostatic latent image formed on the electrophotographic photosensitive member;

a first electroconductive portion;

a second electroconductive portion for having a first portion for cooperating with the first electroconductive portion to provide an electrostatic capacity, wherein the first electroconductive portion and the second electroconductive portion are disposed in such a region that the developer is capable of entering between them, and wherein said second electroconductive portion has a second portion in which an electrostatic capacity is provided between said second portion of said second electroconductive portion and the developer carrying member;

a first electrical contact for receiving a voltage to be applied to the first electroconductive portion from a main assembly of said electrophotographic image forming apparatus;

a developer carrying member electrical contact for receiving a voltage to be applied to the developer carrying member from the main assembly of said electrophotographic image forming apparatus; and a second electrical contact for transmitting, to the main assembly of said electrophotographic image forming apparatus, an electric signal corresponding to an electrostatic capacity between said the electroconductive portion and said first portion of said second electroconductive portion when a voltage is applied to the first electroconductive portion through the first electrical contact and corresponding also to an electrostatic capacity between the developer carrying member and said second portion of said second electroconductive portion when a voltage is applied to the developer carrying member through the developer carrying member electrical contact, to detect in substantially real time the remaining amount of the developer in the process cartridge by the main assembly of said electrophotographic image forming apparatus; and (b) detecting means for detecting in substantially real time the amount of a developer existing in the process cartridge on the basis of the electric signal transmitted from the second electrical contact.

29. An electrophotographic image forming apparatus for forming an image on a recording material, to which a process cartridge is detachably mountable, said apparatus comprising:

(a) mounting means for mounting the process cartridge, which includes:

electrophotographic photosensitive member; and a developing device for developing an electrostatic latent image formed on the electrophotographic photosensitive member, the developing device including:

a developer carrying member for feeding a developer to the electrophotographic photosensitive member to develop the electrostatic latent image formed on the electrophotographic photosensitive member;

first electroconductive portion;

a second electroconductive portion for cooperating with the first electroconductive portion to provide an electrostatic capacity, wherein the first electroconductive portion and the second electroconductive portion are disposed in such a region that the developer is capable of entering between them;

a first electrical contact for receiving a voltage to be applied to the first electroconductive portion from a main assembly of said electrophotographic image forming apparatus;

a developer carrying member electrical contact for receiving a voltage to be applied to the developer carrying member from the main assembly of said electrophotographic image forming apparatus;

a third electroconductive portion for cooperating with the developer carrying member to provide an electrostatic capacity when a voltage is applied to the developer carrying member from the main assembly of said electrophotographic image forming apparatus;

a second electrical contact for transmitting, to the main assembly of said electrophotographic image forming apparatus, a combined electric signal, for permitting the main assembly of said electrophotographic image forming apparatus to detect the remaining amount of the developer in the process cartridge in substantially real time, of an electric signal corresponding to an electrostatic capacity between the first electroconductive portion and the second electroconductive portion when a voltage is applied to the first electroconductive portion through the first electrical contact and an electric signal corresponding to an electrostatic capacity between the developer carrying member and the third electroconductive portion when a voltage is applied to the developer carrying member through the developer carrying member electrical contact, to detect a remaining amount of the developer in the process cartridge by the main assembly of said electrophotographic image forming apparatus; and (b) detecting means for detecting in substantially real time the amount of a developer existing in the process cartridge on the basis of the electric signal transmitted from the second electrical contact.

30. An electrophotographic image forming apparatus according to any one of claims 26–29, wherein the result of the detection is continuously displayed on the basis of an output of said detecting means.

31. A developing frame for a process cartridge which is detachably mountable to a main assembly of an electrophotographic image forming apparatus, said developing frame comprising:

a developer carrying member mounting portion for feeding a developer to an electrophotographic photosensitive member to develop an electrostatic latent image formed on the electrophotographic photosensitive member;

a first electroconductive portion mounting portion for mounting a first electroconductive portion; and a second electroconductive portion mounting portion for mounting a second electroconductive portion for cooperation with the first electroconductive portion mounted to said first electroconductive portion mounting portion to provide an electrostatic capacity, wherein the first electroconductive portion and the second electroconductive portion are disposed in such a region that the developer is capable of entering between them when said developing frame is mounted to the process cartridge, wherein a gap between the first electroconductive portion and the second electroconductive portion is wider at a developer entering side.

32. A developing frame according to claim 31, wherein said first electroconductive portion mounting portion and second electroconductive portion mounting portion are mounted such that the first electroconductive portion and second electroconductive portion are disposed to permit the developer to be feed between the first electroconductive portion and the second electroconductive portion mounted to said first electroconductive portion mounting portion and said second electroconductive portion mounting portion.

33. A developing device for developing an electrostatic latent image formed on an electrophotographic photosensitive member, said developing device being mountable to a main assembly of an electrophotographic image forming apparatus, said developing device comprising:

a developer carrying member from feeding a developer to the electrophotographic photosensitive member to develop the electrostatic latent image formed on the electrophotographic photosensitive member;

a first electroconductive portion;

a second electroconductive portion for cooperating with said first electroconductive portion to provide an electrostatic capacity;

a first electrical contact for receiving a voltage to be applied to said first electroconductive portion from the main assembly of the electrophotographic image forming apparatus;

a third electroconductive portion for cooperating with said developer carrying member to provide an electrostatic capacity when a voltage is applied to said developer carrying member from the main assembly of said electrophotographic image forming apparatus; and a second electrical contact for transmitting, to the main assembly of the electrophotographic image forming apparatus, a combined electric signal of an electric signal corresponding to an electrostatic capacity between said first electroconductive portion and said second electroconductive portion when a voltage is applied to said first electroconductive portion and an electric signal corresponding to an electrostatic capacity between said developer carrying member and the third electroconductive portion when a voltage is applied to said developer carrying member, to detect the remaining amount of the developer by the main assembly of the electrophotographic image forming apparatus, wherein the developer is fed between said first electroconductive portion and said second electroconductive portion, and the developer fed between said first electroconductive portion and said second electroconductive portion is retracted in a direction toward an entering side.

34. A device according to claim 4, 9, 10, or 33, further comprising a regulating member for regulating the amount of the developer deposited on the surface of said developer carrying member, wherein said first electroconductive portion and said second electroconductive portion are disposed such that the developer removed from said developer carrying member by said regulating member circulates between said first electroconductive portion and said second electroconductive portion.

35. A process cartridge detachably mountable to a main assembly of an electrophotographic image forming apparatus, said process cartridge comprising:

(a) electrophotographic photosensitive member; and (b) a developing device for developing an electrostatic latent image formed on said electrophotographic photosensitive member, said developing device including:

a developer carrying member for feeding a developer to said electrophotographic photosensitive member to develop the electrostatic latent image formed on said electrophotographic photosensitive member;

a first electroconductive portion;

a second electroconductive portion for cooperating with said first electroconductive portion to provide an electrostatic capacity;

a first electrical contact for receiving a voltage to be applied to said first electroconductive portion from the main assembly of the electrophotographic image forming apparatus;

a third electroconductive portion for cooperating with said developer carrying member to provide an electrostatic capacity when a voltage is applied to said developer carrying member from the main assembly of the electrophotographic image forming apparatus; and a second electrical contact for transmitting, to the main assembly of the electrophotographic image forming apparatus, a combined electric signal of an electric signal corresponding to an electrostatic capacity between said first electroconductive portion and said second electroconductive portion when a voltage is applied to said first electroconductive portion and an electric signal corresponding to an electrostatic capacity between said developer carrying member and the third electroconductive portion when a voltage is applied to said developer carrying member, to detect the remaining amount of the developer by the main assembly of the electrophotographic image forming apparatus, wherein the developer is fed between said first electroconductive portion and said second electroconductive portion, and the developer fed between said first electroconductive portion and said second electroconductive portion is retracted in a direction toward an entering side.

36. A process cartridge according to claim 14, 16, 21, 22, or 35, further comprising a regulating member for regulating the amount of the developer deposited on the surface of said developer carrying member, wherein said first electroconductive portion and said second electroconductive portion are disposed such that the developer removed from said developer carrying member by said regulating member circulates between said first electroconductive portion and said second electroconductive portion.

37. A developing device for developing an electrostatic latent image formed on an electrophotographic photosensitive drum, said developing device being mountable to a main assembly of an electrophotographic image forming apparatus, said developing device comprising:

a developing roller for developing the electrostatic latent image formed on the electrophotographic photosensitive drum;

a first electroconductive portion;

a second electroconductive portion for cooperating with said first electroconductive portion to provide an electrostatic capacity, wherein said first electroconductive portion and said second electroconductive portion are disposed in such a region that the developer is capable of entering between them, wherein said first electroconductive portion and said second electroconductive portion are in the form of flat plates, and a gap between said first electroconductive portion and said second electroconductive portion is wider at a developer entering side;

a first electrical contact for receiving a voltage to be applied to said first electroconductive portion from the main assembly of the electrophotographic image forming apparatus; and a second electrical contact for transmitting, to the main assembly of the electrophotographic image forming apparatus, an electric signal corresponding to an electrostatic capacity between said first electroconductive portion and said second electroconductive portion when a voltage is applied to said first electroconductive portion to detect in substantially real time the remaining amount of the developer by the main assembly of the electrophotographic image forming apparatus, wherein said second electrical contact is electrically connected with said second electroconductive portion, and said second electroconductive portion is disposed nearer said developing roller than first electroconductive portion.

38. A process cartridge detachably mountable to a main assembly of an electrophotographic image forming apparatus, said process cartridge comprising:

(a) an electrophotographic photosensitive drum, and (b) a developing device for developing an electrostatic latent image formed on said electrophotographic photosensitive drum, said developing device including:

a developing roller for developing the electrostatic latent image formed on said electrophotographic photosensitive drum;

a first electroconductive portion;

a second electroconductive portion for cooperating with said first electroconductive portion to provide an electrostatic capacity, wherein said first electroconductive portion and said second electroconductive portion are disposed in such a region that the developer is capable of entering between them, wherein said first electroconductive portion and said second electroconductive portion are in the form of flat plates, and a gap between said first electroconductive portion and said second electroconductive portion is wider at a developer entering side;

a first electrical contact for receiving a voltage to be applied to said first electroconductive portion from the main assembly of the electrophotographic image forming apparatus; and a second electrical contact for transmitting, to the main assembly of the electrophotographic image forming apparatus, an electric signal corresponding to an electrostatic capacity between said first electroconductive portion and said second electroconductive portion when a voltage is applied to said first electroconductive portion to detect in substantially real time the remaining amount of the developer by the main assembly of the electrophotographic image forming apparatus, wherein said second electrical contact is electrically connected to said second electroconductive portion, and second electroconductive portion is disposed nearer said developing roller than said first electroconductive portion.

39. An electrophotographic image forming apparatus for forming an image on a recording material, comprising:

(a) an electrophotographic photosensitive drum;

(b) an electrostatic latent image forming means for forming an electrostatic latent image on said electrophotographic photosensitive drum;

(c) a developing device for developing an electrostatic latent image formed on said electrophotographic photosensitive drum, said developing device including:

a developing roller for developing the electrostatic latent image formed on said electrophotographic photosensitive drum;

a first electroconductive portion;

a second electroconductive portion for cooperating with said first electroconductive portion to provide an electrostatic capacity, wherein said first electroconductive portion and said second electroconductive portion are disposed in such a region that the developer is capable of entering between them, wherein said first electroconductive portion and said second electroconductive portion are in the form of flat plates, and a gap between said first electroconductive portion and said second electroconductive portion is wider at a developer entering side;

a first electrical contact for receiving a voltage to be applied to said first electroconductive portion from a main assembly of said electrophotographic image forming apparatus; and a second electrical contact for transmitting, to the main assembly of said electrophotographic image forming apparatus, an electric signal corresponding to an electrostatic capacity between said first electroconductive portion and said second electroconductive portion when a voltage is applied to said first electroconductive portion to detect in substantially real time the remaining amount of the developer in said developing device by the main assembly of said electrophotographic image forming apparatus, wherein said second electrical contact is electrically connected with said second electroconductive portion, and said second electroconductive portion is disposed nearer said developing roller than said first electroconductive portion; and (d) detecting means for detecting the amount of a developer existing in said developing device on the basis of the electric signal transmitted from said second electrical contact.

* * * * *

UNITED STATES PATENT AND TRADEMARK OFFICE

CERTIFICATE OF CORRECTION

PATENT NO. : 6,859,627 B2
DATED : February 22, 2005
INVENTOR(S) : Karakama et al.

It is certified that error appears in the above-identified patent and that said Letters Patent is hereby corrected as shown below:

Title page,
Item [56], References Cited, OTHER PUBLICATIONS, insert
-- English translation of Japanese Laid-Open Patent Application No. 9-211960. --.

Column 1,
Line 20, “meaning” should read -- means --.
Line 26, “removable” should read -- removably --.
Line 49, “an” should read -- a --.
Line 52, “electrodes in the form of a rod” should read -- electrodes, each in the form of a rod, --.
Line 56, “eletrostatic” should read -- electrostatic --.

Column 2,
Line 16, “nience” should read -- nient --.

Column 9,
Line 31, “circulates” should read -- circulate --.
Line 57, “while” should read -- white --.

Column 10,
Line 19, “improves” should read -- improve --.

Column 11,
Line 8, “end.” should read -- ends. --.

Column 13,
Line 11, “electrodes,” should read -- electrode, --.
Line 13, “the first electrode 83” should read -- the first electrode 81. --.

Column 15,
Line 28, “is” should read -- are --.

Column 19,
Line 22, “or” should read -- and --.

Column 20,
Line 23, “developing a” should read -- developing an --.

UNITED STATES PATENT AND TRADEMARK OFFICE

CERTIFICATE OF CORRECTION

PATENT NO. : 6,859,627 B2
DATED : February 22, 2005
INVENTOR(S) : Karakama et al.

It is certified that error appears in the above-identified patent and that said Letters Patent is hereby corrected as shown below:

Column 22,
Line 34, “claim 14” should read -- claim 16 --.
Line 35, “or” should read -- and --.

Column 23,
Line 36, “electrophotographic” should read -- an electrophotographic --.

Column 24,
Line 61, “the” should be deleted.

Column 25,
Line 19, “electrophotographic” should read -- an electrophotographic --.
Line 28, “first” should read -- a first --.

Column 26,
Line 37, “feed” should read -- fed --.

Column 27,
Line 16, “claim 4” should read -- claim 1, 4, --.
Line 28, “(a)” should read -- (a) an --.

Column 28,
Line 46, “than” should read -- than said --.

Signed and Sealed this

Eighth Day of November, 2005

JON W. DUDAS
*Director of the United States Patent and Trademark Office*